US009266245B2

(12) United States Patent
Kammer et al.

(10) Patent No.: US 9,266,245 B2
(45) Date of Patent: Feb. 23, 2016

(54) ELECTRIC HAIR TRIMMER

(71) Applicant: Rovcal, LLC, Madison, WI (US)

(72) Inventors: Carl Gottfried Kammer, Middleton, WI (US); Andrew David Johnson, Madison, WI (US)

(73) Assignee: SPECTRUM BRANDS, INC., Middleton, WI (US)

( * ) Notice: Subject to any disclaimer, the term of this patent is extended or adjusted under 35 U.S.C. 154(b) by 275 days.

(21) Appl. No.: 13/739,528

(22) Filed: Jan. 11, 2013

(65) Prior Publication Data

US 2013/0192068 A1 Aug. 1, 2013

Related U.S. Application Data

(60) Provisional application No. 61/585,923, filed on Jan. 12, 2012, provisional application No. 61/621,788, filed on Apr. 9, 2012.

(51) Int. Cl.

| | |
|---|---|
| ***B26B 19/06*** | (2006.01) |
| ***B26B 19/38*** | (2006.01) |
| ***B26B 19/12*** | (2006.01) |
| ***B65D 75/36*** | (2006.01) |

(52) U.S. Cl.

CPC ..... *B26B 19/12* (2013.01); *B26B 19/386* (2013.01); *B65D 75/36* (2013.01)

(58) Field of Classification Search

CPC ..... B26B 19/12; B26B 19/386; B65D 75/36
See application file for complete search history.

(56) References Cited

U.S. PATENT DOCUMENTS

| | | | | |
|---|---|---|---|---|
| 402,727 | A | | 5/1889 | Eisenhuth |
| 564,832 | A | | 7/1896 | McCown |
| 908,368 | A | | 12/1908 | Williams |
| 1,919,748 | A | | 7/1933 | Roberts |
| 1,929,838 | A | | 10/1933 | Crane |
| 1,956,042 | A | * | 4/1934 | Oster ..... 30/221 |
| 2,012,703 | A | | 8/1935 | Alm |
| 2,029,792 | A | | 2/1936 | Pluchino |
| 2,138,241 | A | | 11/1938 | Koch et al. |
| 2,182,597 | A | | 12/1939 | Oster |
| 2,217,760 | A | | 10/1940 | Martin |
| 2,222,106 | A | | 11/1940 | Knapp |
| 2,379,969 | A | | 7/1945 | Kobler et al. |
| 2,545,533 | A | | 3/1951 | Stewart |

(Continued)

FOREIGN PATENT DOCUMENTS

| | | | |
|---|---|---|---|
| CN | 2801427 | Y | 8/2006 |
| CN | 2850858 | Y | 12/2006 |

(Continued)

OTHER PUBLICATIONS

Extended Search Report for EP Application No. 11187549.8 mailed Feb. 10, 2012.

(Continued)

*Primary Examiner* — Hwei C Payer
(74) *Attorney, Agent, or Firm* — Armstrong Teasdale LLP

(57) ABSTRACT

An electric hair trimmer generally includes a handle, a drive system, and a cutter head. The cutter head includes a stationary blade and a movable blade, and the cutter head is releasably connectable to the handle in operative connection with the drive system. The handle is configured for ejecting the cutter head.

8 Claims, 20 Drawing Sheets

(56) References Cited

U.S. PATENT DOCUMENTS 2,726,442 A 12/1955 Miller
2,726,443 A 12/1955 Miller
2,749,613 A 6/1956 Miller
2,768,438 A 10/1956 Coggins et al.
2,790,283 A 4/1957 Spencer
2,911,715 A 11/1959 Seifert
2,983,045 A 5/1961 Diatikar, Jr
2,991,553 A 7/1961 Levine
3,041,726 A 7/1962 Hitson
3,103,743 A 9/1963 Kobler et al.
3,149,418 A 9/1964 Milbourne
3,165,831 A 1/1965 Carrol
3,222,781 A 12/1965 Luther et al.
3,279,062 A 10/1966 Andis
3,295,201 A 1/1967 Pucino
3,295,202 A 1/1967 Pucino
3,388,831 A 6/1968 Hansom
3,644,992 A * 2/1972 Bennett et al. ..... 30/64
3,648,370 A 3/1972 Cercone
3,696,915 A 10/1972 Douglas
3,741,046 A 6/1973 Chambon
3,748,732 A * 7/1973 Frantz et al. ..... 30/43.1
3,797,657 A 3/1974 Petrillo
3,835,532 A 9/1974 Petrillo
3,844,036 A 10/1974 Wahl et al.
3,918,154 A 11/1975 Pagani
3,921,270 A 11/1975 Upton
3,970,194 A 7/1976 Iten
4,203,214 A 5/1980 Fogle
4,214,365 A 7/1980 Mack et al.
4,221,050 A 9/1980 Walter et al.
4,285,428 A 8/1981 Beddall et al.
4,348,810 A 9/1982 Oda et al.
4,498,237 A 2/1985 Mack et al.
4,581,822 A 4/1986 Fujimura
4,694,575 A 9/1987 Boerger
4,765,060 A 8/1988 Veselaski et al.
4,813,133 A 3/1989 Locke et al.
4,837,929 A * 6/1989 Tanahashi et al. ..... 30/43.92
4,867,184 A 9/1989 Davis
4,899,444 A 2/1990 Trichell et al.
4,980,974 A 1/1991 Radcliffe
5,016,352 A 5/1991 Metcalf
5,050,305 A 9/1991 Baker et al.
5,054,199 A 10/1991 Ogawa et al.
5,068,966 A 12/1991 Wahl et al.
5,092,048 A 3/1992 Sukow et al.
5,185,931 A 2/1993 Fujikawa et al.
5,230,153 A 7/1993 Andis
5,327,648 A 7/1994 Ullmann
5,363,958 A 11/1994 Horan
5,518,114 A 5/1996 Kohring et al.
5,568,688 A 10/1996 Andrews
5,575,069 A 11/1996 Roberto Kneeland
5,579,581 A 12/1996 Melton
5,606,799 A 3/1997 Melton
5,636,442 A 6/1997 Wain
5,699,616 A 12/1997 Ogawa
5,794,342 A 8/1998 Davey
5,867,907 A 2/1999 Terry et al.
5,937,526 A 8/1999 Wahl et al.
5,979,056 A 11/1999 Andrews
5,979,060 A 11/1999 Holzbauer et al.
6,029,354 A 2/2000 Apprille, Jr. et al.
6,041,926 A 3/2000 Petricca et al.
6,052,903 A 4/2000 Metcalf et al.
6,076,263 A 6/2000 Andis et al.
6,079,103 A 6/2000 Melton et al.
6,085,426 A 7/2000 Metcalf et al.
6,185,827 B1 2/2001 Polites
6,192,586 B1 2/2001 Metcalf et al.
6,237,232 B1 5/2001 Petricca et al.
6,276,060 B1 8/2001 Faulstich et al.
6,279,234 B1 8/2001 Chaouachi et al.
6,378,210 B1 4/2002 Bickford
6,393,702 B1 5/2002 Laube
6,413,599 B1 7/2002 Petricca et al.
6,421,922 B2 7/2002 Beutel et al.
6,427,337 B1 8/2002 Burks
6,473,973 B2 11/2002 Laube
6,490,798 B2 12/2002 Morisugi et al.
6,499,595 B1 12/2002 Petricca
6,505,404 B2 1/2003 Ullmann
6,618,948 B2 9/2003 Lin et al.
6,648,140 B2 11/2003 Petricca
6,658,740 B2 12/2003 Habben
6,684,507 B2 2/2004 Lau et al.
6,684,508 B2 2/2004 Brzesowsky et al.
6,742,262 B2 6/2004 Rizzuto, Jr. et al.
6,862,810 B2 3/2005 Braun et al.
6,886,255 B2 5/2005 Freas et al.
6,886,690 B2 5/2005 Petricca
6,901,664 B2 6/2005 Melton et al.
6,968,623 B2 11/2005 Braun et al.
6,973,855 B2 12/2005 Yanosaka et al.
7,010,859 B2 3/2006 Laube
7,051,442 B2 5/2006 McCambridge et al.
7,073,262 B2 7/2006 Melton
7,080,458 B2 7/2006 Andis
7,100,286 B2 9/2006 Nakakura et al.
7,188,422 B2 3/2007 McCambridge et al.
7,219,430 B2 5/2007 Fandrey et al.
7,249,416 B2 7/2007 Yamaguchi et al.
7,346,990 B2 3/2008 Dirks et al.
7,413,078 B2 8/2008 Fischer et al.
7,426,785 B2 9/2008 Ho
7,500,313 B2 3/2009 Fandrey et al.
7,509,743 B2 3/2009 Oh
7,536,789 B2 5/2009 Michel
D594,613 S 6/2009 Kammer et al.
D594,614 S 6/2009 Kammer et al.
7,581,319 B1 9/2009 Little et al.
7,621,394 B2 11/2009 McCambridge et al.
7,624,506 B2 12/2009 Melton et al.
7,631,757 B2 12/2009 Petricca
7,685,720 B2 3/2010 Efthimiadis et al.
7,698,822 B2 4/2010 Kostner et al.
7,703,210 B2 4/2010 Lau
7,748,123 B2 7/2010 Bednar
7,762,001 B2 7/2010 Morisugi et al.
8,006,834 B2 8/2011 Marcinkowski
8,033,022 B2 10/2011 Ben-Ari
8,033,023 B2 10/2011 Johnson et al.
8,051,571 B2 11/2011 Andis et al.
8,136,250 B2 3/2012 Floessholzer
8,136,253 B2 3/2012 Zoot et al.
2002/0083595 A1 7/2002 Ullmann
2002/0116831 A1 8/2002 Coffin
2002/0189112 A1 12/2002 Peyser
2004/0049921 A1 3/2004 Freas et al.
2004/0068873 A1 4/2004 Tona
2004/0069666 A1 4/2004 Zieger
2004/0181953 A1 9/2004 Follo et al.
2004/0181954 A1 9/2004 Follo et al.
2004/0216311 A1 11/2004 Follo
2005/0055834 A1 3/2005 Cheah et al.
2005/0097757 A1 5/2005 McCambridge et al.
2005/0198825 A1 9/2005 Apprille, Jr.
2006/0080837 A1 4/2006 Johnson et al.
2006/0143925 A1 7/2006 Johnson et al.
2007/0204469 A1 9/2007 Caric et al.
2007/0213742 A1 9/2007 Callahan
2007/0289144 A1 12/2007 Morisugi et al.
2008/0000089 A1 1/2008 Pennella et al.
2008/0201957 A1 8/2008 Apprille
2008/0216324 A1 9/2008 Tauer
2008/0282550 A1 11/2008 Piwaron
2008/0295340 A1 12/2008 Carlucci et al.
2008/0301948 A1 12/2008 Kostner et al.
2009/0000124 A1 1/2009 Micinilio et al.
2009/0000125 A1 1/2009 Peyser et al.
2009/0056137 A1 3/2009 Royle
2009/0056139 A1 3/2009 Royle
2009/0106981 A1 4/2009 Palmer et al.

(56) References Cited

U.S. PATENT DOCUMENTS

| | | | |
|---|---|---|---|
| 2009/0119924 | A1 | 5/2009 | Bozikis |
| 2009/0165303 | A1 | 7/2009 | Burgess et al. |
| 2009/0188117 | A1 | 7/2009 | Putzer |
| 2009/0199406 | A1 | 8/2009 | Gratsias et al. |
| 2009/0241975 | A1 | 10/2009 | Nakakura |
| 2009/0271995 | A1 | 11/2009 | Efthimiadis et al. |
| 2009/0320296 | A1 | 12/2009 | Morisugi et al. |
| 2010/0011585 | A1 | 1/2010 | Maichel et al. |
| 2010/0037463 | A1 | 2/2010 | Maichel et al. |
| 2010/0064520 | A1 | 3/2010 | Park et al. |
| 2010/0083508 | A1 | 4/2010 | Cheng |
| 2010/0205808 | A1 | 8/2010 | King |
| 2010/0229396 | A1 | 9/2010 | Bednar |
| 2010/0236072 | A1 | 9/2010 | Szczepanowski et al. |
| 2010/0281698 | A1 | 11/2010 | King |
| 2011/0010942 | A1 | 1/2011 | Lau |
| 2011/0023310 | A1 | 2/2011 | Psimadas et al. |
| 2011/0035950 | A1 | 2/2011 | Royle |
| 2011/0088269 | A1 | 4/2011 | Walker, Jr. et al. |
| 2011/0139646 | A1 | 6/2011 | Sonnenberg |
| 2011/0139647 | A1 | 6/2011 | Petricca et al. |
| 2011/0139648 | A1 | 6/2011 | Sonnenberg |
| 2011/0139649 | A1 | 6/2011 | Marcinkowski |
| 2011/0167639 | A1 | 7/2011 | Lau |
| 2011/0197450 | A1 | 8/2011 | Taub et al. |
| 2011/0219620 | A1 | 9/2011 | Rehbein et al. |
| 2011/0308087 | A1 | 12/2011 | Rehbein et al. |
| 2012/0110859 | A1 | 5/2012 | Kammer |
| 2012/0233865 | A1 | 9/2012 | Kammer |
| 2012/0233866 | A1 | 9/2012 | Kammer |
| 2012/0317816 | A1 | 12/2012 | Murgida |
| 2013/0192068 | A1 * | 8/2013 | Kammer et al. ..... 30/43.9 |

FOREIGN PATENT DOCUMENTS

| | | | |
|---|---|---|---|
| CN | 201329599 | Y | 10/2009 |
| CN | 202439035 | U | 9/2012 |
| CN | 203062818 | U | 7/2013 |
| DE | 10320412 | A1 | 11/2004 |
| DE | 202006007059 | U1 | 10/2006 |
| DE | 202013105155 | U1 | 11/2013 |
| EP | 349870 | A2 | 1/1990 |
| EP | 447131 | A2 | 9/1991 |
| EP | 707926 | A1 | 4/1996 |
| EP | 934806 | A1 | 8/1999 |
| EP | 1500475 | A2 | 1/2005 |
| EP | 1535708 | A1 | 6/2005 |
| EP | 1697095 | A1 | 9/2006 |
| EP | 1722942 | A1 | 11/2006 |
| EP | 1867446 | A1 | 12/2007 |
| EP | 1932633 | A1 | 6/2008 |
| EP | 2450161 | A1 | 5/2012 |
| EP | 2 614 938 | A3 * | 8/2013 |
| FR | 2887172 | A1 | 12/2006 |
| GB | 470034 | A | 8/1937 |
| GB | 1002685 | A | 8/1965 |
| GB | 2460698 | A | 12/2009 |
| JP | 54104968 | A | 8/1979 |
| JP | 1033853 | A | 2/1998 |
| JP | 2008183400 | A | 8/2008 |
| WO | 9408762 | A1 | 4/1994 |
| WO | 9603334 | A1 | 2/1996 |
| WO | 9836879 | A1 | 8/1998 |
| WO | 0051793 | A1 | 9/2000 |
| WO | 2005056251 | A1 | 6/2005 |
| WO | 2006051620 | A1 | 5/2006 |
| WO | 2006096372 | A1 | 9/2006 |
| WO | 2006108126 | A1 | 10/2006 |
| WO | 2006136685 | A1 | 12/2006 |
| WO | 2007008625 | A1 | 1/2007 |
| WO | 2009024900 | A1 | 2/2009 |
| WO | 2009142115 | A1 | 11/2009 |
| WO | 2010022011 | A1 | 2/2010 |
| WO | 2010101983 | A1 | 9/2010 |

OTHER PUBLICATIONS

Extended Search Report for EP Application No. 13150959.8 mailed Jul. 26, 2013.

Partial Search Report for EP Application No. 13150959.8 mailed Apr. 10, 2013.

* cited by examiner

ELECTRIC HAIR TRIMMER

CROSS-REFERENCE TO RELATED APPLICATIONS

This application claims the benefit of U.S. Provisional Application No. 61/585,923 filed on Jan. 12, 2012 and U.S. Provisional Application No. 61/621,788 filed on Apr. 9, 2012, which are incorporated herein in their entirety.

BACKGROUND

The present invention relates generally to electric hair trimmers and, more particularly, to an electric hair trimmer with a detachable cutter head.

Conventional electric hair trimmers typically include a handle and a cutter head attached to the handle. The cutter head has a stationary cutting blade and a movable (reciprocating or oscillating) cutting blade that are arranged in sliding, face-to-face contact with one another. In operation, the reciprocating blade is driven back and forth relative to the stationary blade as the trimmer is moved over the skin in an area to be trimmed, such that hair entering the teeth of the blades is trimmed. If the user wants to replace or clean the cutter head after a trimming operation, the user grasps the cutter head with his/her hand and detaches the cutter head from the handle. The user then grasps another cutter head and attaches the other cutter head to the handle for use in subsequent trimming operations. However, in some settings (e.g., surgical settings), it is undesirable to touch the cutter head in order to attach or detach the cutter head from the handle.

There is a need, therefore, for an electric hair trimmer having a cutter head that is attachable and/or detachable from the handle without the user having to touch the cutter head with his/her hands.

SUMMARY

In one embodiment, an electric hair trimmer generally includes a handle, a drive system, and a cutter head. The cutter head includes a stationary blade and a movable blade, and the cutter head is releasably connectable to the handle in operative connection with the drive system. The handle is configured for ejecting the cutter head.

In another embodiment, a handle for an electric hair trimmer having a cutter head with a stationary blade and a movable blade generally includes a drive system configured to oscillate the movable blade relative to the stationary blade when the cutter head is connected to the handle. The handle also includes a spring-loaded slide for ejecting the cutter head from the handle.

In yet another embodiment, a cutter head for an electric hair trimmer having a handle with a drive system and an ejection mechanism generally includes a cutting assembly having a stationary blade, a movable blade, and a follower connected to the movable blade. The follower is configured for operative connection with the drive system of the handle for oscillating the movable blade relative to the stationary blade. The cutter head also includes a housing having a tongue configured to provide clearance for the follower when the cutter head is ejected from the handle via the ejection mechanism.

In yet another embodiment, a packaging unit for a cutter head of an electric hair trimmer having a handle generally includes a cutter head having a stationary blade and a movable blade configured for oscillation relative to the stationary blade. The packaging unit also includes a blister having a blister support segment. The cutter head is disposed within the blister such that the handle is connectable to the cutter head by insertion into the cutter head in a direction that is oblique to the blister support segment.

In yet another embodiment, a cutter head for an electric hair trimmer having a handle with a drive system and an ejection mechanism generally includes a housing releasably connectable with the handle in operative connection with the ejection mechanism. The housing is configured for ejection from the handle by said ejection mechanism. The cutter head further includes a cutting assembly at least partially disposed within the housing for ejection from the handle along with the housing. The cutting assembly includes a stationary blade having a plurality of teeth, wherein each stationary blade tooth comprises a tip, and a movable blade having a plurality of teeth, wherein each movable blade tooth comprises a tip and wherein the movable blade teeth are maintained in shearing contact with the stationary blade teeth along a shearing plane. The cutting assembly further includes a follower connected to the movable blade for operative connection with the drive system of the handle to oscillate the movable blade. The housing comprises a plurality of guard teeth adjacent the movable blade teeth.

BRIEF DESCRIPTION

Corresponding reference characters indicate corresponding parts throughout the several views of the drawings.

DETAILED DESCRIPTION

Figure 1:
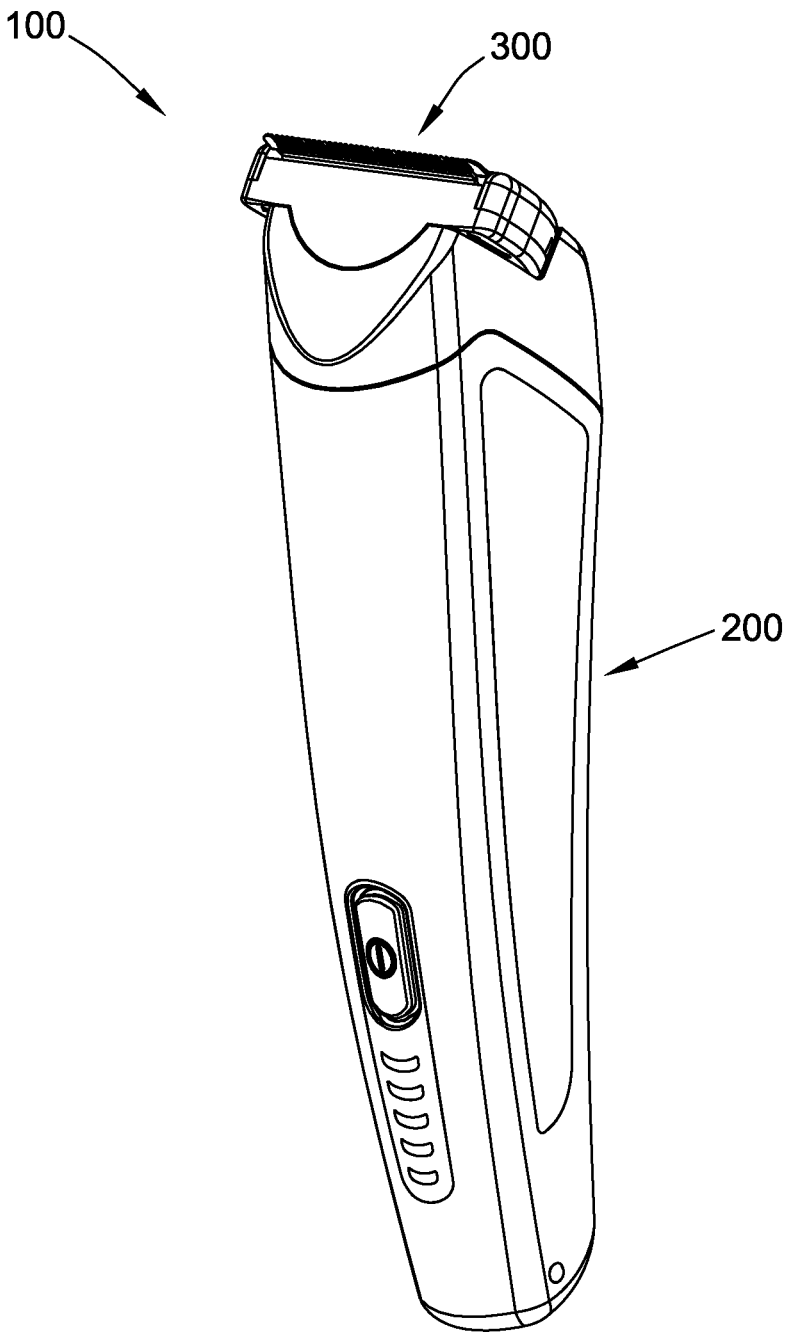
FIG. 1 is a perspective view of one embodiment of an electric hair trimmer.

Referring now to the drawings, and in particular to FIG. 1, an electric hair trimmer according to one embodiment is indicated generally by the reference numeral 100 and is illustrated in the form of a surgical trimmer used for trimming the hair of patients prior to surgery. It is understood, however, that embodiments of the hair trimmer may also be used for trimming facial hair (e.g., a moustache or beard), for trimming the hair on one's head, or for any other suitable purpose without departing from the scope of this invention. The illustrated electric hair trimmer 100 comprises a handle, generally indicated at 200, and a cutter head, generally indicated at 300, releasably connected to the handle 200.

Figure 2:
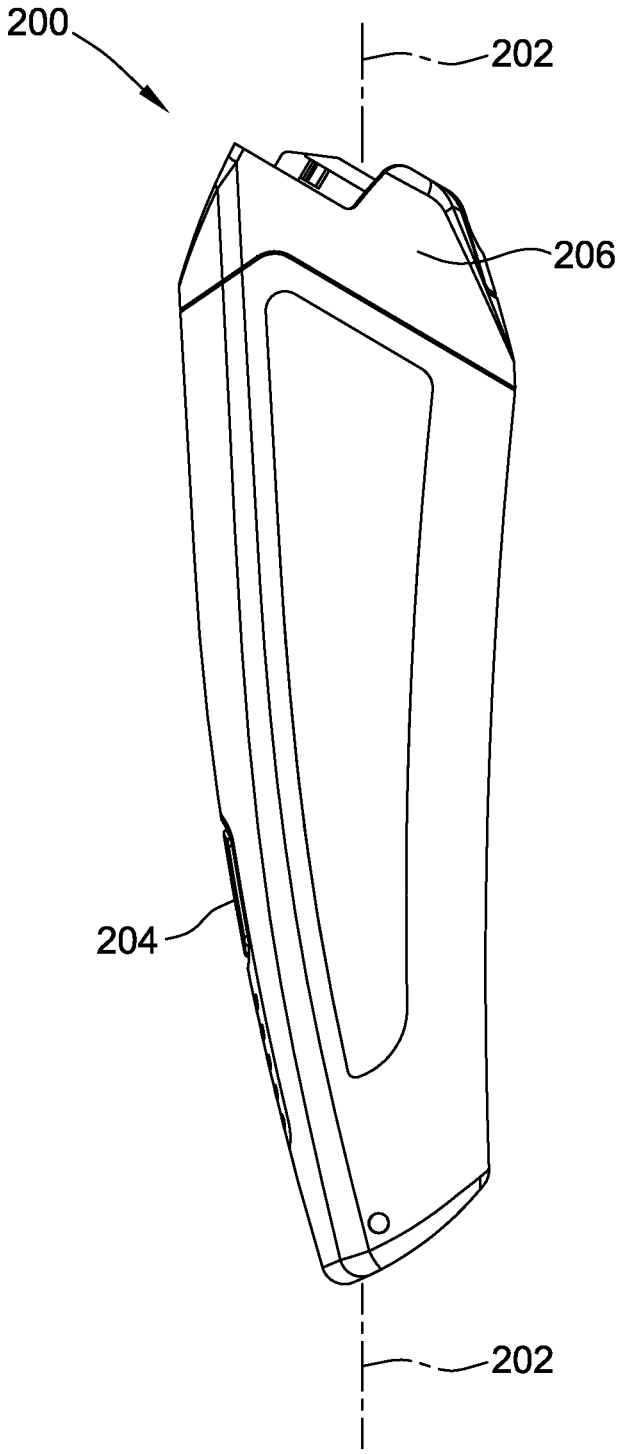
FIG. 2 is a side view of a handle of the electric hair trimmer of FIG. 1.
Figure 3:
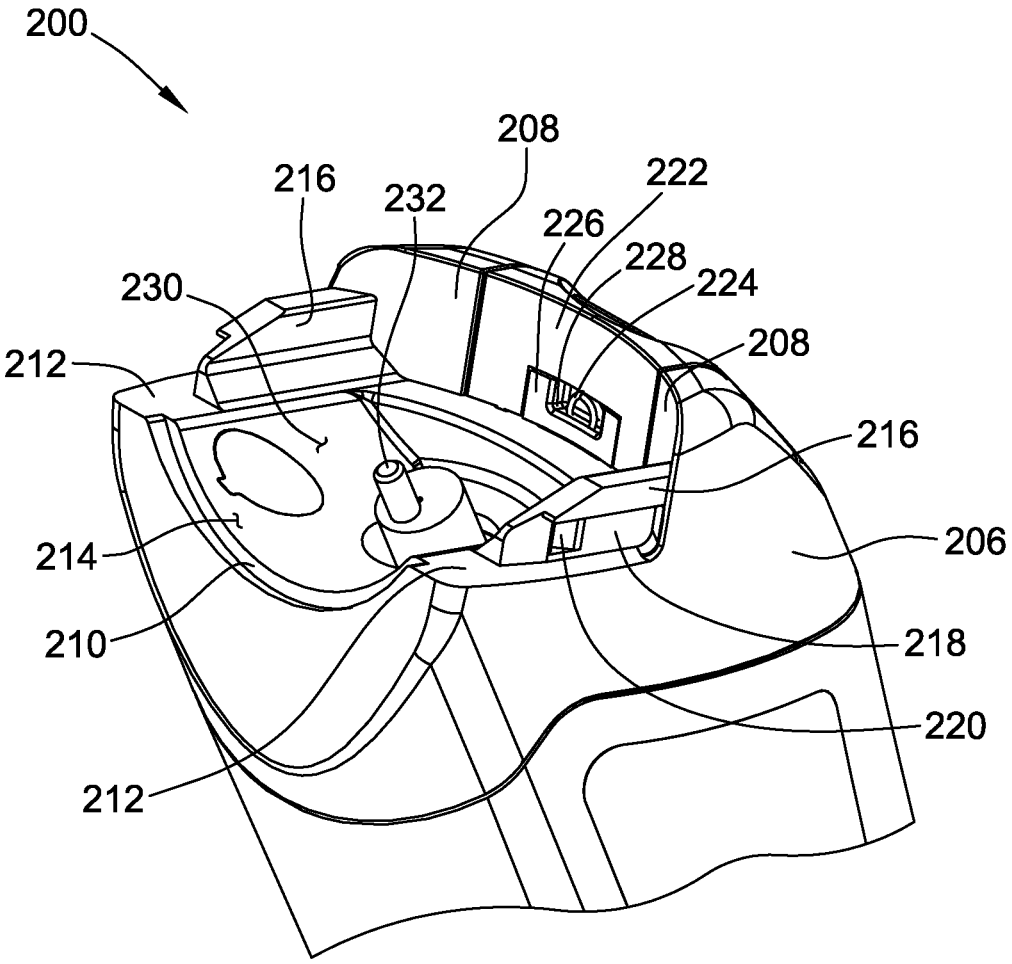
FIG. 3 is an enlarged perspective view of a neck of the handle of FIG. 2.
Figure 4:
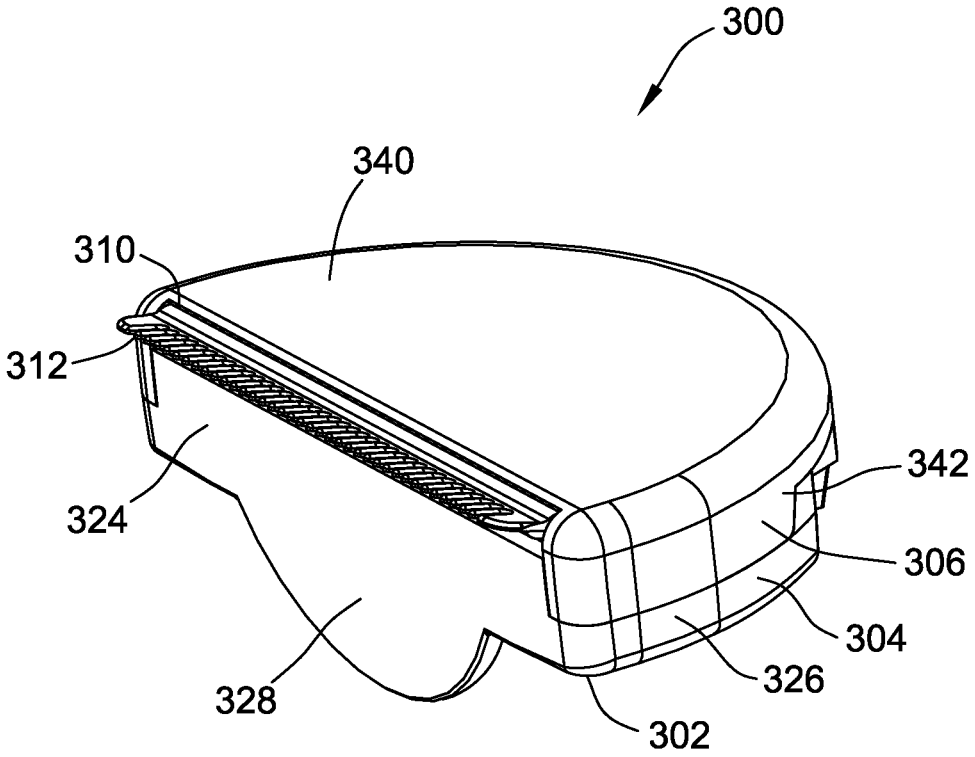
FIG. 4 is a perspective view of a cutter head of the electric hair trimmer of FIG. 1.
Figure 5:
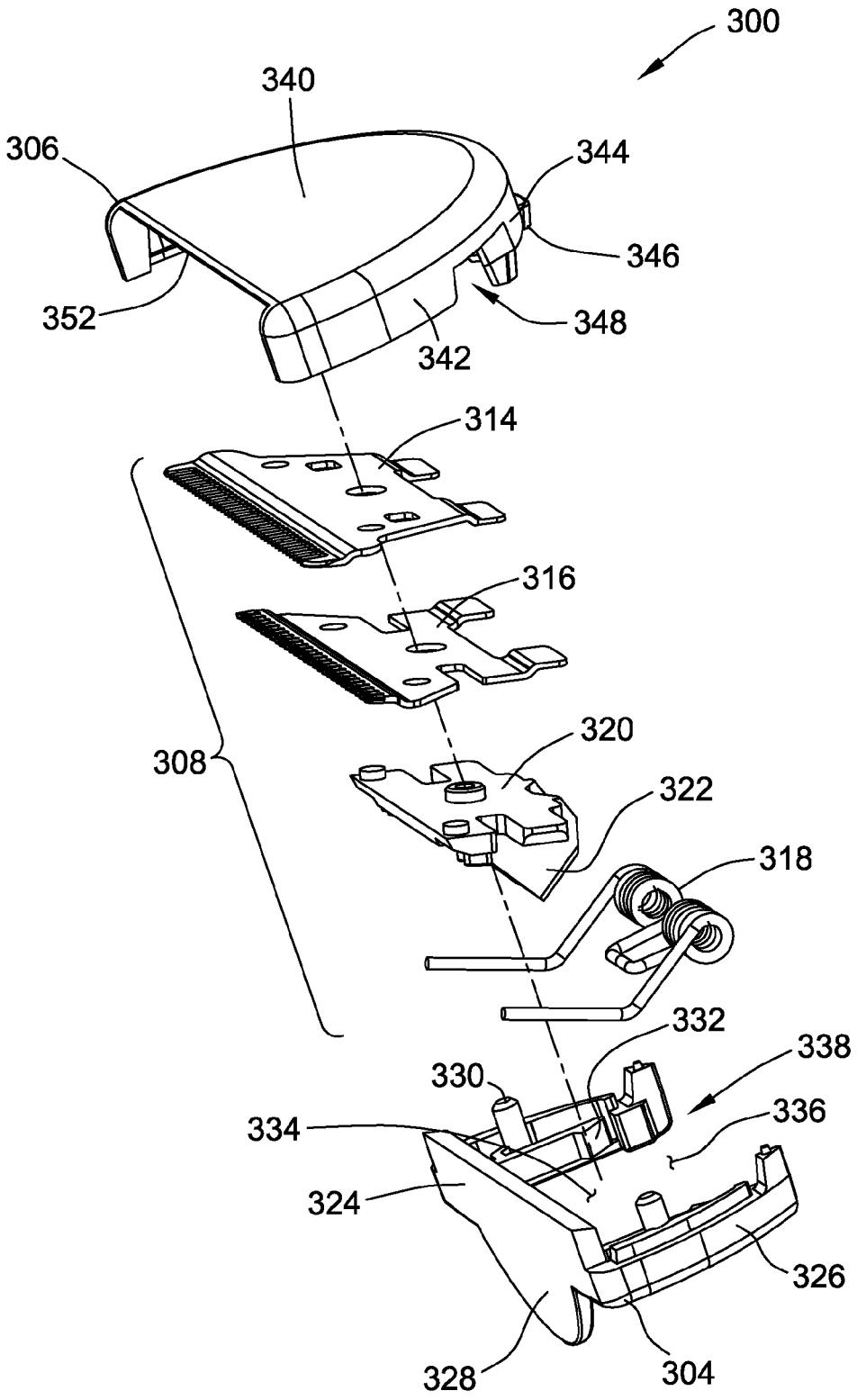
FIG. 5 is an exploded view thereof.
Figure 6:
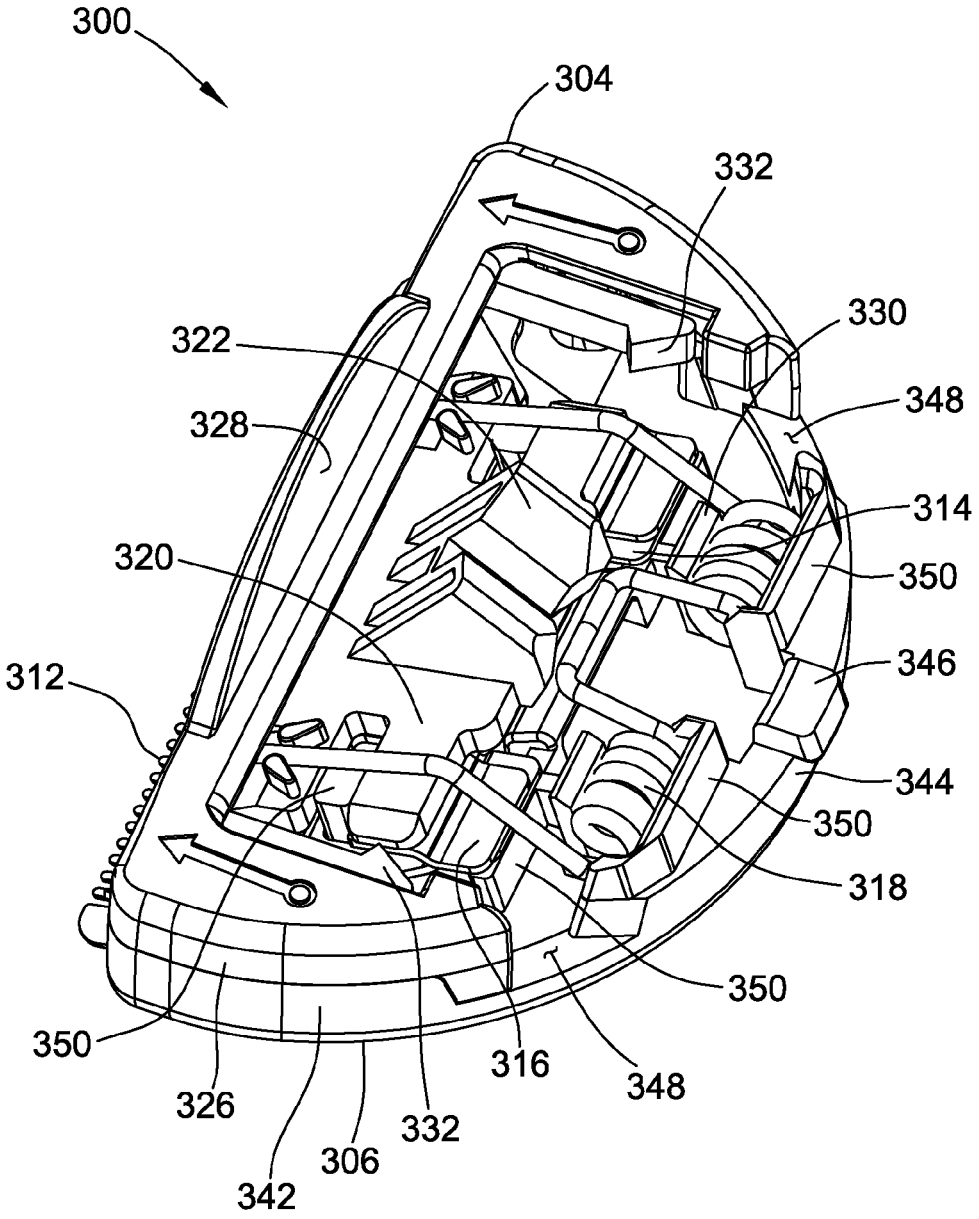
FIG. 6 is a bottom perspective view thereof.
Figure 7:
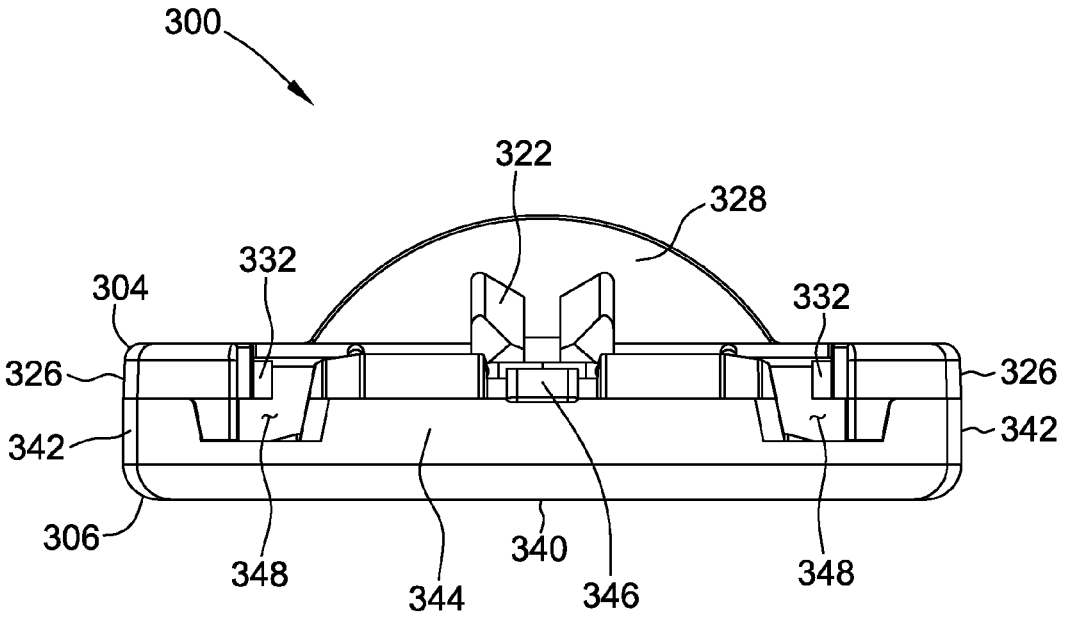
FIG. 7 is a rear elevation thereof.

With reference to FIGS. 2 and 3, the illustrated handle 200 has a longitudinal axis 202, and houses a suitable rechargeable battery, a motor, and associated electronics (e.g., circuitry), all of which are not illustrated in the Figures but are known to those skilled in the art for operating the trimmer 100. Accessible by a user on an exterior of the handle 200 are an electrical socket (not shown) for charging the battery, a user interface (e.g., a power switch 204) for operating the trimmer 100, and a neck 206 at which the cutter head 300 releasably connects to the handle 200.

Referring to FIG. 3, the illustrated neck 206 includes a pair of back seating surfaces 208, a front seating surface 210, and a pair of side seating surfaces 212. Each side seating surface 212 extends forward from a respective one of the back seating surfaces 208, and the front seating surface 210 extends arcuately between the side seating surfaces 212 to define an aperture 214 that provides clearance for the cutter head 300 when the cutter head 300 is ejected from the handle 200 as described in more detail below.

A winged guide wall 216 is formed integrally with, and is disposed between, each side seating surface 212 and its associated back seating surface 208 to define a pair of opposed, outwardly-facing channels 218 that each has a retaining recess 220. An ejection mechanism (e.g., a slide 222 that is spring-loaded via a spring 224) is disposed between the back seating surfaces 208 about a fixedly located spring seat 226 having a retaining recess 228. The slide 222 is configured to be manually displaceable toward the front seating surface 210 and over the spring seat 226 (e.g., either against or with the bias of the spring 224 seated against the spring seat 226) to facilitate ejecting the cutter head 300 from the handle 200. In other embodiments, the neck 206 may be configured in any suitable manner that facilitates enabling the cutter head 300 to be attached to and/or detached from the handle 200 as described herein.

In the illustrated embodiment, the neck 206 generally defines a pocket 230. A drive pin 232 (e.g., an eccentric drive pin or an oscillating drive pin) extends outward from the handle 200 for disposition within the pocket 230. The drive pin 232 is operatively connected to a drive shaft (not shown) of the motor and is configured for operative connection with the cutter head 300. The drive pin 232 extends generally parallel to the longitudinal axis 202 of the handle 200, while the side seating surfaces 212 and the channels 218 are oriented obliquely relative to the longitudinal axis 202. In this manner, the side seating surfaces 212 and the channels 218 decline toward the back seating surfaces 208 such that the neck 206 is configured to support the cutter head 300 for attachment to and detachment from the handle 200 at an oblique angle relative to the longitudinal axis 202 as described in more detail below.

As illustrated in FIGS. 4-7, the cutter head 300 according to one embodiment suitably comprises a two-piece housing 302 including a lower housing component 304 and an upper housing component 306 that are configured for assembly with each other to house a cutting assembly 308 in an interior compartment of the cutter head 300. The lower and upper housing components 304, 306 are configured to define an elongate opening or slot 310 in the assembled housing 302 from which a front edge 312 of the cutting assembly 308 extends for trimming hair.

The cutting assembly 308 comprises a stationary blade 314 and a movable or reciprocating blade 316 that is biased against the stationary blade 314 via a suitable biasing member (e.g., a coil spring 318) such that the movable blade 316 remains in sliding, face-to-face contact with the stationary blade 314 during operation of the trimmer 100. The teeth of each of the blades 314, 316 extend outward through the slot 310 of the housing 302 to collectively define the front edge 312 of the cutting assembly 308. The cutting assembly 308 also comprises a base 320 that extends downward from the movable blade 316 such that a follower 322, which is operatively connected to the movable blade 316, is accessible for oscillating the movable blade 316. In other embodiments, the cutting assembly 308 may have any suitable components arranged in any suitable manner that enables the cutter head 300 to function as described herein.

The lower housing component 304 of the housing 302 has a front wall 324 and opposing side walls 326 extending from the front wall 324. The front wall 324 has a tongue 328 that is sized to cover the aperture 214 in the neck 206 when the cutter head 300 is connected to the handle 200. While the tongue 328 is substantially arcuately shaped in this embodiment, the tongue 328 may be any suitable shape and remain within the scope of this invention. The lower housing component 304 also has a pair of interior bosses 330, a pair of inwardly facing, resiliently flexible clips 332, an open bottom 334 and an open back 336. The open bottom 334 and back 336 together define an inlet 338 into which the neck 206 of the handle 200 is insertable for releasable connection of the cutter head 300 to the handle 200 via the clips 332 and the slide 222.

The upper housing component 306 comprises a top wall 340, a pair of opposing side walls 342, and a back wall 344. The back wall 344 includes a rearwardly extending tab 346, and is spaced apart from the side walls 342 to define openings 348. Support members 350 (FIG. 6) are disposed on the upper housing component 306 to facilitate locating, orienting, and retaining the cutting assembly 308 within the interior compartment of the housing 302 upon assembly of the cutter head 300. At least a portion 352 of the front of the upper housing component 306 is open such that, when connected together with the front wall 324 of the lower housing component 304, the portion 352 and the front wall 324 define the elongate slot 310 of the housing 302 through which the cutting assembly 308 extends from the interior compartment of the housing 302.

To assemble the cutter head 300, the upper housing component 306 is oriented with the top wall 340 facing downward (i.e., on the surface of a table), and the cutting assembly 308 is suitably located on the upper housing component 306 via the support members 350. The lower housing component 304 is then connected to the upper housing component 306 via the interior bosses 330 and/or any other suitable connector (e.g., a snap-fit mechanism, an adhesive, thermal bonding and/or welded connection, and/or another suitable mechanical fastener) such that the housing components 304, 306 house the cutting assembly 308 in the interior compartment of the cutter head 300. The side walls 342 of the upper housing component 306 abut the side walls 326 of the lower housing component 304 to substantially enclose the cutting assembly 308 within the housing 302 except for the front edge 312 that extends outward from the elongate slot 310 of the housing 302. The support members 350 suitably locate (e.g., maintain the orientation and position of) the cutting assembly 308 within the housing 302. It should be noted, however, that the housing 302 may be of other than the two-piece construction, such as a single piece or more than two pieces, without departing from the scope of this invention.

When the cutting assembly 308 is held within the housing 302, the base 320 of the cutting assembly 308 is accessible through the open bottom 334 of the lower housing component 304, for operative connection of the follower 322 with the drive pin 232. Because the tongue 328 of the lower housing component 304 has a larger profile than that of the follower 322 of the cutting assembly 308 (FIG. 7), the follower 322 is provided with adequate clearance for ejection of the cutter head 300 from the handle 200 at an oblique angle relative to the longitudinal axis 202 of the handle 200 without interference from the neck 206.

In the illustrated embodiment, the cutter head 300 is suitably fabricated from materials such that the entire cutter head is disposable after use. Additionally, because the cutter head 300 is intended to be disposable in one embodiment, the amount of material used to make the cutter head 300 should be minimized such that the cutter head 300 can be manufactured in a less expensive manner. Hence, the accurate shape of the tongue 328 permits the front wall 324 to be sized large enough to provide clearance for the follower 322 during ejection, while enabling the side walls 326 to be sized smaller than the front wall 324 in order to reduce the amount of material used to manufacture the cutter head 300. In other embodiments, the cutter head 300 may be fabricated from materials that are suitable for long-term, repeated use, such that the cutter head 300 is not intended to be disposable. The stationary and/or movable blades 314, 316 described herein may suitably be fabricated from a ceramic material, or from a metallic material that is at least partially coated in a synthetic or semi-synthetic, organic-based polymer (e.g., polytetrafluoroethylene (PTFE)).

Figure 8:
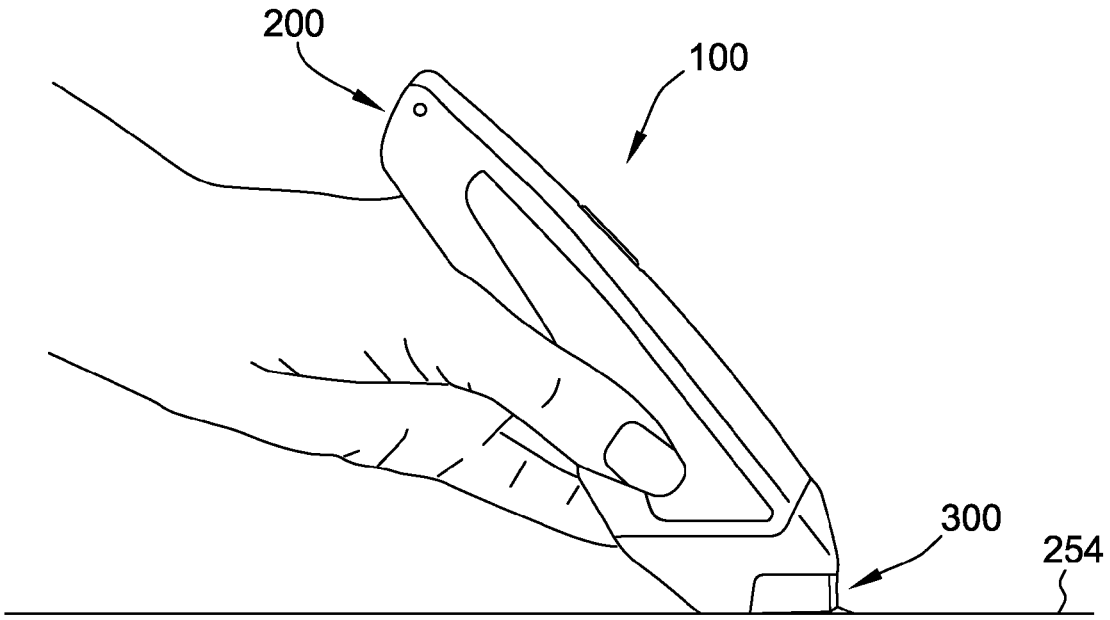
FIG. 8 is a schematic illustration of the electric hair trimmer of FIG. 1 during a trimming operation.

To connect the cutter head 300 to the handle 200, the winged guide walls 216 are inserted through the openings 348 of the upper housing component 306. As the cutter head 300 is moved down the decline of the side seating surfaces 212 and toward the back seating surfaces 208, the clips 332 of the cutter head 300 slide along the channels 218 until they engage (i.e., are inserted into) the retaining recesses 220 of the channels 218. When the clips 332 engage the retaining recesses 220, the cutter head 300 is seated against the back seating surfaces 208 with the tab 346 inserted into the retaining recess 228 of the spring seat 226, and the tongue 328 of the lower housing component 304 is correspondingly in contact with the arcuate front seating surface 210 of the neck 206. Additionally, the drive pin 232 of the handle 200 is operatively connected with (e.g., inserted into) the follower 322 of the cutting assembly 308. With the drive pin 232 operatively connected with the follower 322, the follower 322, and hence the movable blade 316, can be oscillated via operation of the motor. FIG. 8 illustrates one particularly suitable orientation of the trimmer 100 (i.e., of the handle 200 and the cutter head 300) relative to a shaving surface 354 during operation of the trimmer 100.

Figure 9:
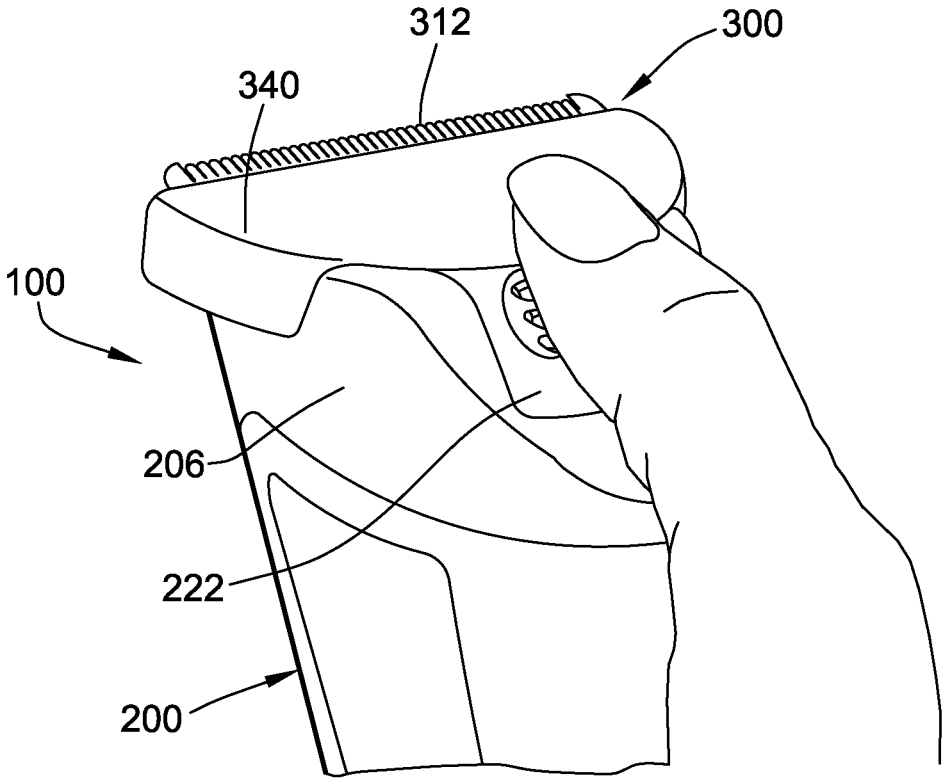
FIG. 9 is a schematic illustration of a user detaching the cutter head from the handle after the trimming operation.

Referring now to FIG. 9, after a trimming operation, the ejection mechanism (e.g., the slide 222) may be used to eject the cutter head 300 from the handle 200 (e.g., by pushing the slide 222 against the bias of the spring 224) such that the ejection mechanism displaces the cutter head 300 up the incline of the side seating surfaces 212. In this manner, the clips 332 disengage (e.g., are removed from) the retaining recesses 220, and the tab 346 disengages (e.g., is removed from) the retaining recess 228 such that the cutter head 300 moves away from the back seating surfaces 208. The follower 322 also disengages from the drive pin 232.

Because the tongue 328 of the front wall 324 has a profile that is larger than that of the follower 322 (FIG. 7), the follower 322 is provided with adequate clearance for passing through the aperture 214 in the neck 206, thereby enabling the cutter head 300 to be ejected from the handle 200 at an oblique trajectory relative to the longitudinal axis 202 of the handle 200. The user may therefore eject the cutter head 300 from the handle 200 and into a suitable container (e.g., a container of cleaning fluid or a container of waste) without the user having to touch the cutter head 300 with his/her hands. As used herein, the term "eject" refers to applying a force to the cutter head 300 in order to completely disconnect the cutter head 300 from the handle 200 and displace the cutter head 300 into a trajectory relative to the handle 200 without a user having to touch the cutter head 300 with his/her hands and without the application of a secondary force (e.g., without the user having to pull the cutter head 300 away from the handle 200, without the user having to shake the handle 200 to detach the cutter head 300, without the user having to invert the handle 200 to detach the cutter head 300 via the force of gravity, etc.).

Figure 10:
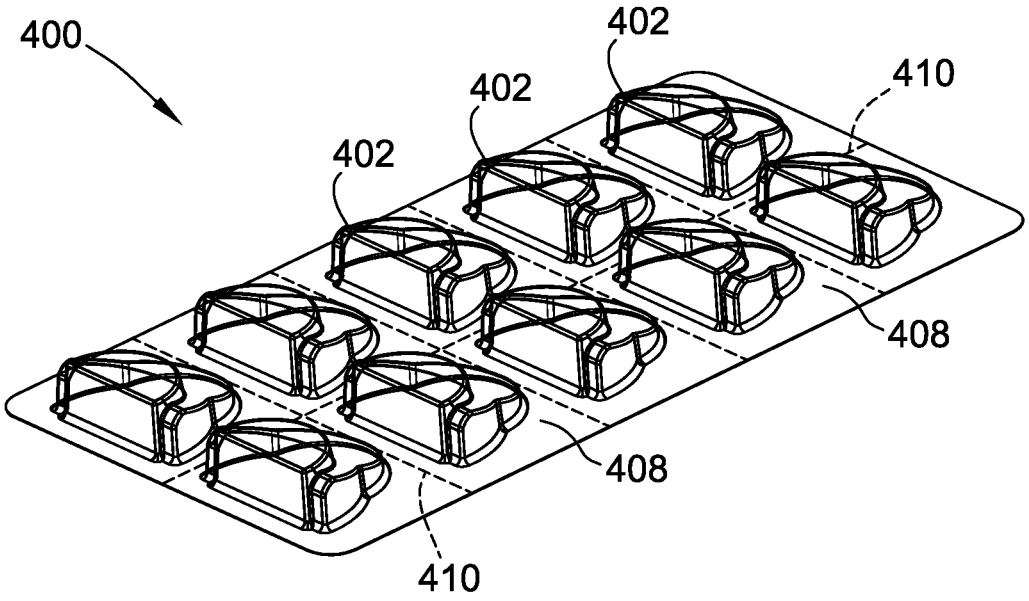
FIG. 10 is a perspective view of a packaging unit having a plurality of individually packaged cutter heads of FIG. 4.

After a used cutter head 300 has been ejected from the handle 200 as described above, a new cutter head 300 may be attached to the handle 200 for use in a subsequent trimming operation. In the illustrated embodiment, new cutter heads 300 are provided in a packaging unit 400 of individually sealed cutter head packages 402 (FIG. 10). Each cutter head package 402 includes a blister 404 (FIG. 11) and a cover 406 (FIG. 11) connected (e.g., via an adhesive) to the blister 404 to seal the cutter head 300 within its associated package 402 in an airtight, watertight, and/or sterile environment.

The packages 402 are suitably connected together via webs 408 having lines of weakness (e.g., perforations 410 in the illustrated embodiment) such that each package 402 is separable from the packaging unit 400 at the lines of weakness without disturbing the sealed nature of the packages 402 remaining in the packaging unit 400. Once a package 402 has been separated from the packaging unit 400, the cover 406 of the package 402 can be suitably removed for accessing the associated cutter head 300. The remaining packages 402 of the packaging unit 400 continue to store new cutter heads 300 for future use. In one embodiment, the blisters 404 and the covers 406 are formed from synthetic or semi-synthetic, organic-based materials (e.g., "plastic" materials) using molding processes. In other embodiments, the blisters 404 and/or the covers 406 may be formed from any suitable material using any suitable manufacturing processes that facilitate enabling the packages 402 to function as described herein.

Figure 11:
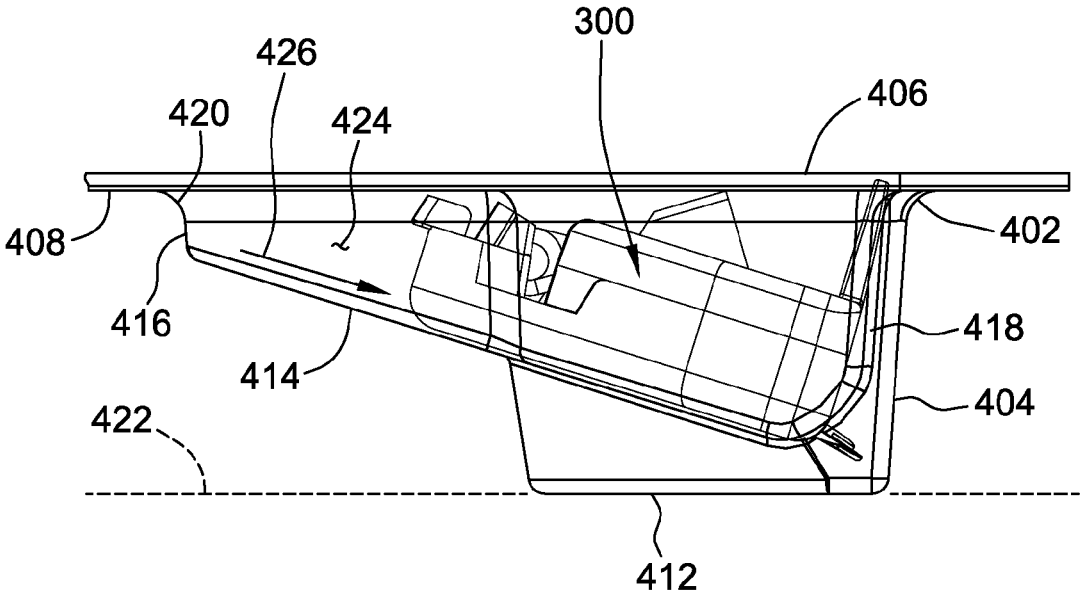
FIG. 11 is a side view of one of the individually packaged cutter heads of FIG. 10.
Figure 12:
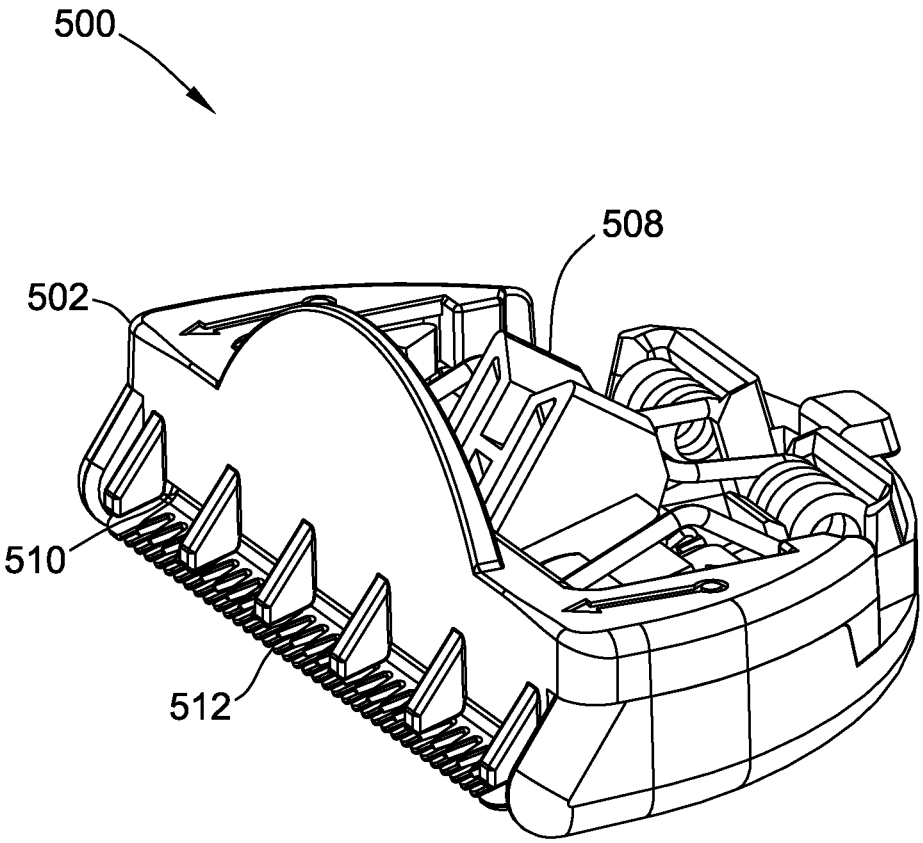
FIG. 12 is a perspective view of another cutter head of the electric hair trimmer of FIG. 1.
Figure 13:
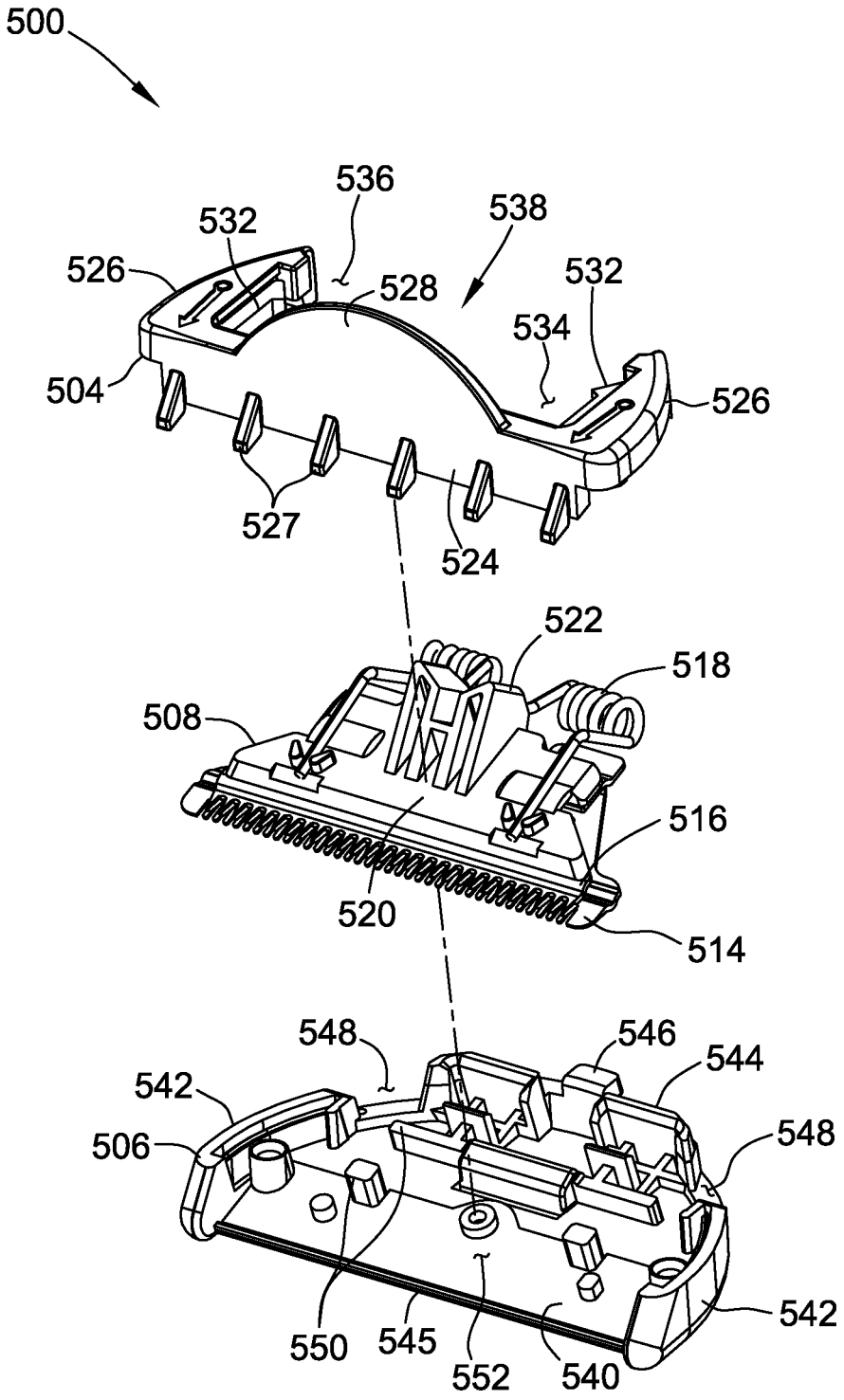
FIG. 13 is an exploded view of the cutter head of FIG. 12.
Figure 14:
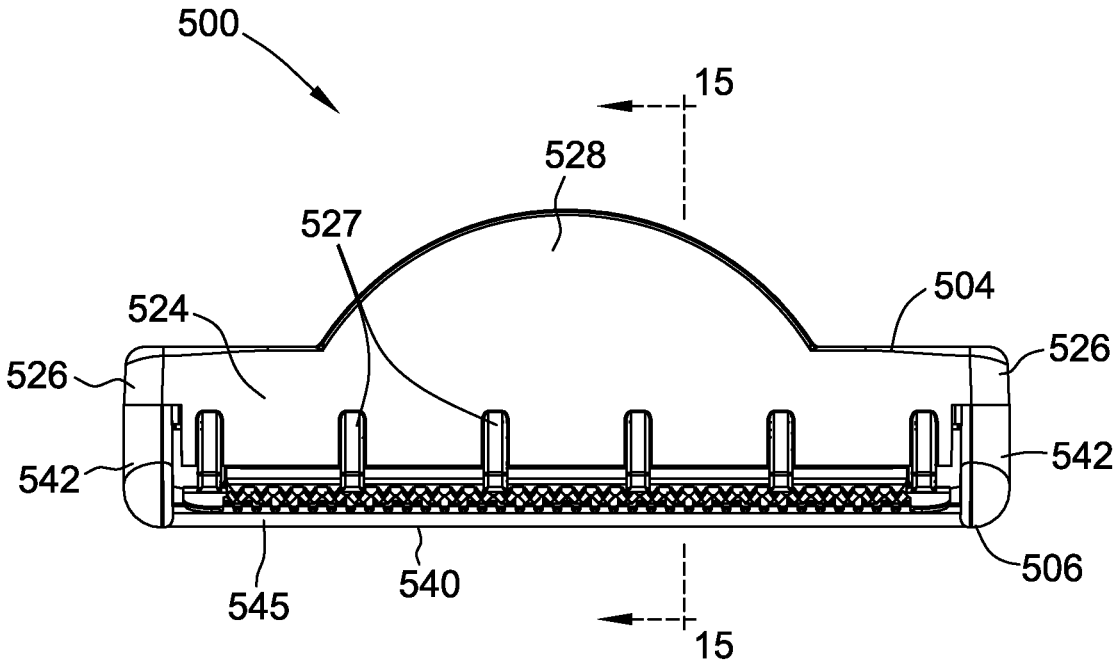
FIG. 14 is a front elevation of the cutter head of FIG. 12.

With reference to FIG. 11, each blister 404 is formed with a blister support segment 412 and a cutter head support segment 414 that is obliquely oriented relative to the blister support segment 412. The blister support segment 412 is bounded by a peripheral side segment 416 having a forward region 418 and a rearward region 420. The cutter head support segment 414 is oriented at an oblique angle relative to the blister support segment 412 such that, when the blister support segment 412 is seated on a resting surface 422 such as a countertop, the cutter head support segment 414 supports the cutter head 300 at an angle that facilitates attaching the cutter head 300 to the handle 200 without the user having to touch the cutter head 300 with his/her hands. More specifically, the cutter head support segment 414 is sized such that a gap 424 is defined between the rearward region 420 of the peripheral side segment 416 and the cutter head 300 when the cutter head 300 is seated on the cutter head support segment 414.

As an example of attaching the cutter head 300 to the handle 200, the user may grasp the blister 404 (e.g., at the webs 408) and insert the neck 206 of the handle 200 (i.e., the winged guide walls 216) into the gap 424. The user may then move the neck 206 in a direction 426 that is oblique to the blister support segment 412 such that the winged guide walls 216 are inserted into the cutter head 300 via the openings 348 to attach the cutter head 300 to the handle 200 via the clips 332 and the tab 346 as described above. After the cutter head 300 is attached to the handle 200, the cutter head 300 may be withdrawn from the blister 404 in an assembled configuration with the handle 200 for use in a trimming operation. The package 402 thereby enables a user to attach a new cutter head 300 to the handle 200 without having to touch the new cutter head 300 with his/her hands.

As illustrated in FIGS. 12-15, a cutter head (indicated generally at 500) according to another embodiment suitably comprises a two-piece housing 502 including a lower housing component 504 and an upper housing component 506 that are configured for assembly with each other to house a cutting assembly 508 in an interior compartment of the cutter head 500. The lower and upper housing components 504, 506 are configured to define an elongate opening or slot 510 in the assembled housing 502 from which a front edge 512 of the cutting assembly 508 extends for trimming hair.

The cutting assembly 508 comprises a stationary blade 514 and a movable or reciprocating blade 516 that is biased against the stationary blade 514 via a suitable biasing member (e.g., a coil spring 518) such that the movable blade 516 remains in sliding, face-to-face contact with the stationary blade 514 during operation of the trimmer 100. The teeth of each of the blades 514, 516 extend outward through the slot 510 of the housing 502 to collectively define the front edge 512 of the cutting assembly 508. The cutting assembly 508 also comprises a base 520 that extends downward from the movable blade 516 such that a follower 522, which is operatively connected to the movable blade 516, is accessible for oscillating the movable blade 516. In other embodiments, the cutting assembly 508 may have any suitable components arranged in any suitable manner that enables the cutter head 500 to function as described herein.

The lower housing component 504 of the housing 502 has a front wall 524, opposing side walls 526 integrally formed with and extending rearward from the front wall 524, and a plurality of guard teeth 527 integrally formed with and extending forward from the front wall 524. The front wall 524 has a tongue 528 that is sized to cover the aperture 214 in the neck 206 when the cutter head 500 is connected to the handle 200. While the tongue 528 is substantially arcuately shaped in this embodiment, the tongue 528 may be any suitable shape and remain within the scope of this invention. The lower housing component 504 also has a pair of interior bosses (not shown), a pair of inwardly facing, resiliently flexible clips 532, an open bottom 534, and an open back 536. The open bottom 534 and back 536 together define an inlet 538 into which the neck 206 of the handle 200 is insertable for releasable connection of the cutter head 500 to the handle 200 via the clips 532 and the slide 222.

Figure 15:
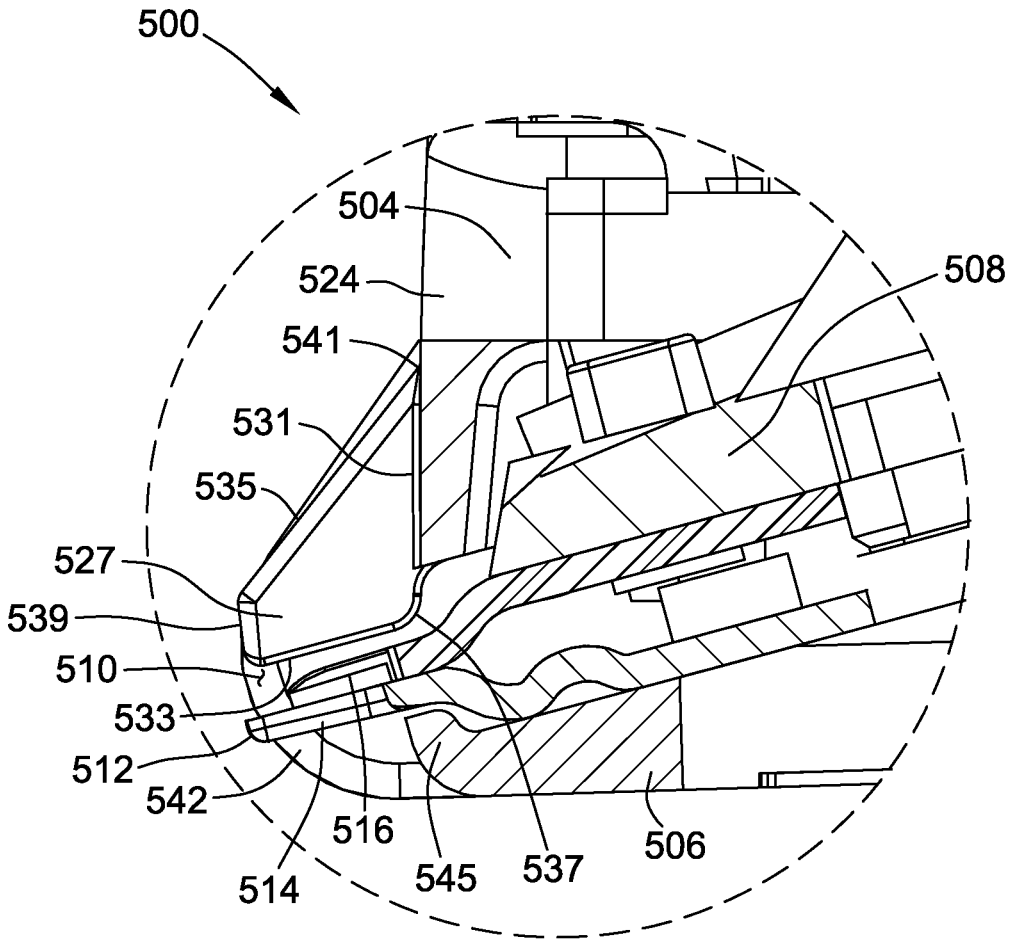
FIG. 15 is a cross-section taken in the plane of line 15-15 of FIG. 14.
Figure 16:
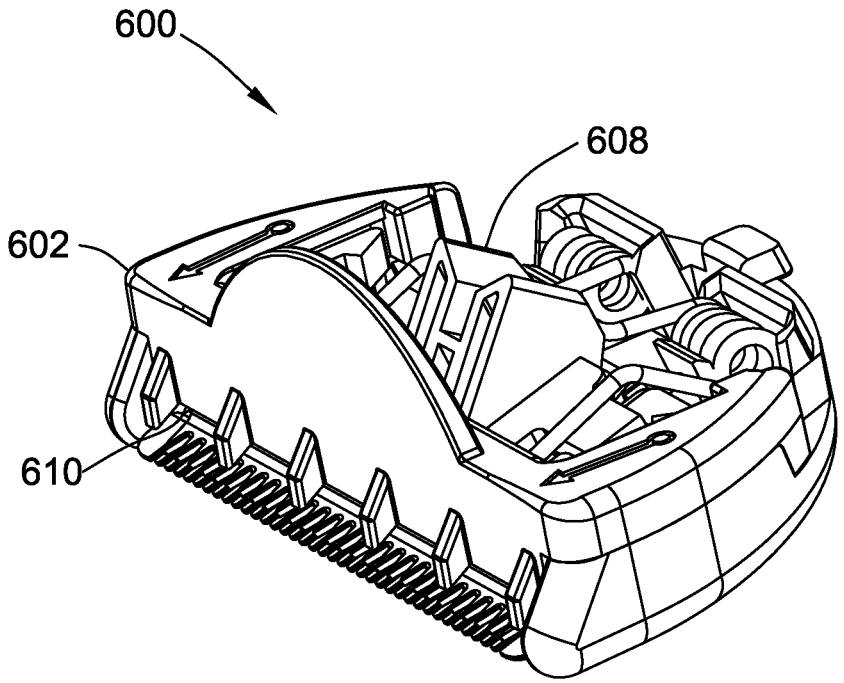
FIG. 16 is a perspective view of another cutter head of the electric hair trimmer of FIG. 1.
Figure 17:
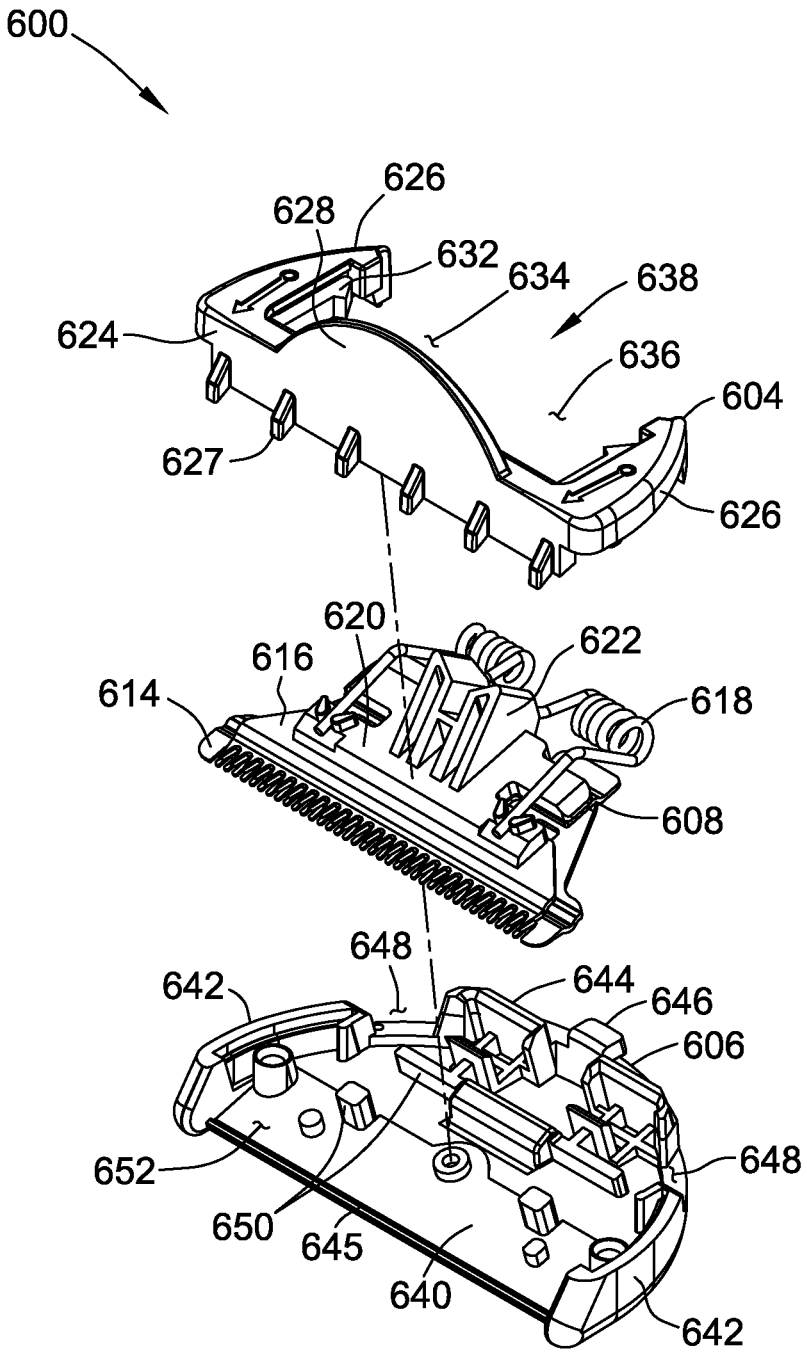
FIG. 17 is an exploded view of the cutter head of FIG. 16.
Figure 18:
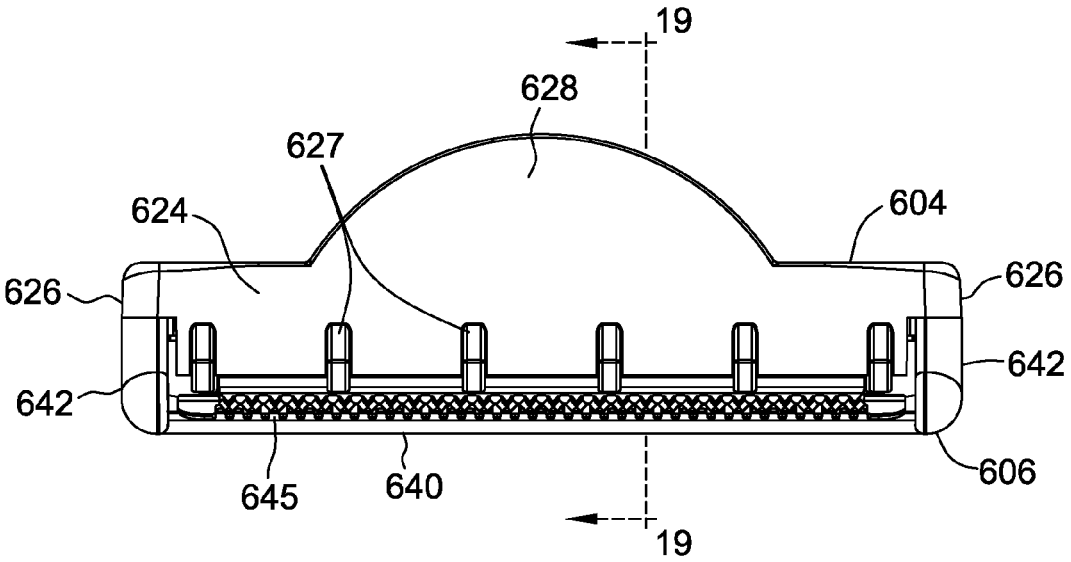
FIG. 18 is a front elevation of the cutter head of FIG. 16.
Figure 19:
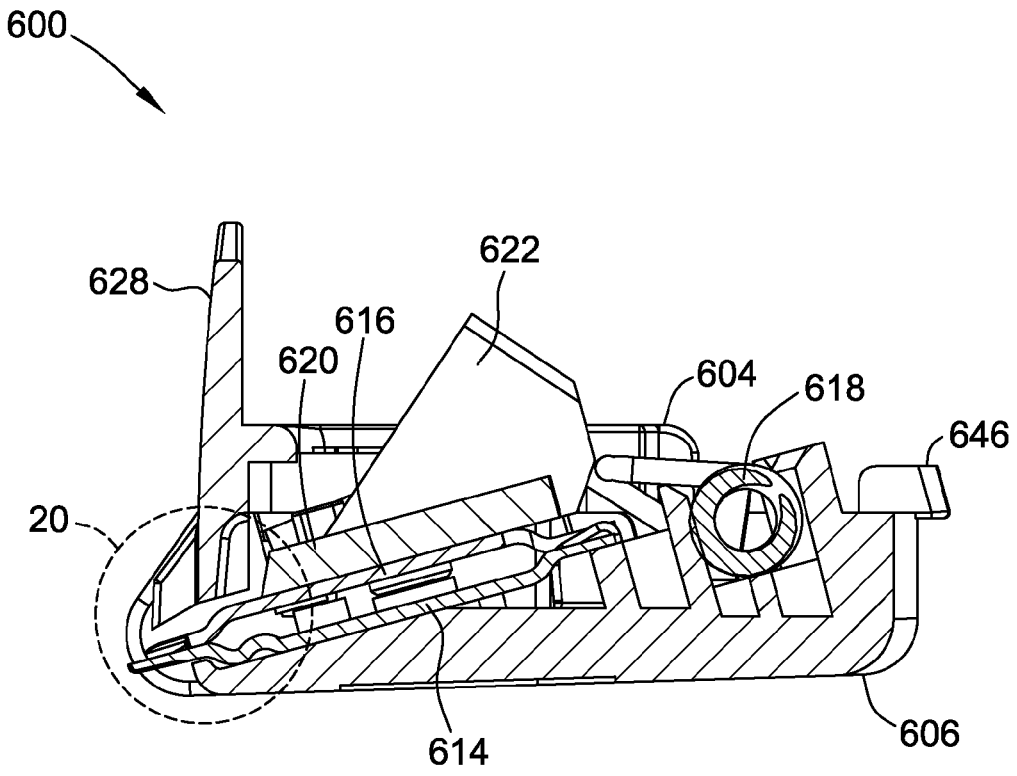
FIG. 19 is a cross-section taken in the plane of line 19-19 of FIG. 18.

In the illustrated embodiment, the guard teeth 527 are substantially equally spaced apart from one another along the front wall 524, and each guard tooth 527 has a generally triangular profile (FIG. 15). The generally triangular profile has a first side 531, a second side 533 extending substantially perpendicular to the first side 531, and a third side 535 extending obliquely between the first side 531 and the second side 533. The first side 531 and the second side 533 are connected at a first vertex region 537; the second side 533 and the third side 535 are connected at a second vertex region 539; and the first side 531 and the third side 535 are connected at a third vertex region 541. The first side 531 is at least in part joined with the front wall 524 to define a proximal base of the tooth 527, and the second vertex region 539 defines a distal tip of the tooth 527. In other embodiments, the guard teeth 527 may have any suitable spacing and/or profile shape that facilitates enabling the guard teeth 527 to function as described herein.

The upper housing component 506 comprises a top wall 540, a pair of opposing side walls 542, and a back wall 544. The top wall 540 includes a front lip 545 oriented toward the blades 514, 516, and each of the side walls 542 extends forward of the front lip 545. The back wall 544 includes a rearwardly extending tab 546, and the back wall 544 is spaced apart from the side walls 542 to define openings 548. Support members 550 are disposed on the upper housing component 506 to facilitate locating, orienting, and retaining the cutting assembly 508 within the interior compartment of the housing 502 upon assembly of the cutter head 500. At least a portion 552 of the front of the upper housing component 506 is open such that, when connected together with the front wall 524 of the lower housing component 504, the portion 552 and the front wall 524 define the elongate slot 510 of the housing 502 through which the cutting assembly 508 extends from the interior compartment of the housing 502.

To assemble the cutter head 500, the upper housing component 506 is oriented with the top wall 540 facing downward (i.e., on the surface of a table), and the cutting assembly 508 is suitably located on the upper housing component 506 via the support members 550. The lower housing component 504 is then connected to the upper housing component 506 via the interior bosses (not shown) and/or any other suitable connector (e.g., a snap-fit mechanism, an adhesive, thermal bonding and/or welded connection, and/or another suitable mechanical fastener) such that the housing components 504, 506 house the cutting assembly 508 in the interior compartment of the cutter head 500. It should be noted, however, that the housing 502 may be of other than the two-piece construction, such as a single piece or more than two pieces, without departing from the scope of this invention.

The side walls 542 of the upper housing component 506 abut the side walls 526 of the lower housing component 504 to substantially enclose the cutting assembly 508 within the housing 502 except for the front edge 512 that extends outward from the elongate slot 510 of the housing 502. The support members 550 suitably locate (e.g., maintain the orientation and position of) the cutting assembly 508 within the housing 502, and the second side 533 of each guard tooth 527 is oriented to be substantially parallel to the teeth of the blades 514, 516 with the second vertex region 539 of each guard tooth 527 being substantially aligned with the front edge 512 of the cutting assembly 508. In this manner, the guard teeth 527 are configured to facilitate lifting hairs and preventing skin from being cut during operation of the trimmer 100. Additionally, the front lip 545 provides a thickened region of the top wall 540 at the elongate opening 510 (FIG. 15) to facilitate minimizing deflection (e.g., bending or warping) of the top wall 540 and, therefore, deflection (e.g., bending or warping) of the stationary blade 514 during operation of the trimmer 100.

Moreover, while the side walls 542 extend forward of the front lip 545 and forward of the movable blade 516 (FIG. 15), the stationary blade 514 extends forward of the side walls 542 for contacting the skin during trimming. In this manner, because the side walls 542 extend beyond the movable blade 516 but not beyond the stationary blade 514, the side walls 542 are configured to be close enough to the front edge 512 to support the skin near the front edge 512 during trimming (e.g., the side walls 542 are configured to facilitate absorbing a load when excessive force is applied to the stationary blade 514 by a user).

When the cutting assembly 508 is held within the housing 502, the base 520 of the cutting assembly 508 is accessible through the open bottom 534 of the lower housing component 504, for operative connection of the follower 522 with the drive pin 232. Because the tongue 528 of the lower housing component 504 has a larger profile than that of the follower 522 of the cutting assembly 508 (FIG. 12), the follower 522 is provided with adequate clearance for ejection of the cutter head 500 from the handle 200 at an oblique angle relative to the longitudinal axis 202 of the handle 200 without interference from the neck 206.

In the illustrated embodiment, the cutter head 500 is suitably fabricated from materials such that the entire cutter head is disposable after use. Additionally, because the cutter head 500 is intended to be disposable in one embodiment, the amount of material used to make the cutter head 500 should be minimized such that the cutter head 500 can be manufactured in a less expensive manner. Hence, the arcuate shape of the tongue 528 permits the front wall 524 to be sized large enough to provide clearance for the follower 522 during ejection, while enabling the side walls 526 to be sized smaller than the front wall 524 in order to reduce the amount of material used to manufacture the cutter head 500. In other embodiments, the cutter head 500 may be fabricated from materials that are suitable for long-term, repeated use, such that the cutter head 500 is not intended to be disposable. The stationary and/or movable blades 514, 516 described herein may suitably be fabricated from a ceramic material, or from a metallic material that is at least partially coated in a synthetic or semi-synthetic, organic-based polymer (e.g., polytetrafluoroethylene (PTFE)).

To connect the cutter head 500 to the handle 200, the winged guide walls 216 are inserted through the openings 548 of the upper housing component 506. As the cutter head 500 is moved down the decline of the side seating surfaces 212 and toward the back seating surfaces 208, the clips 532 of the cutter head 500 slide along the channels 218 until they engage (i.e., are inserted into) the retaining recesses 220 of the channels 218. When the clips 532 engage the retaining recesses 220, the cutter head 500 is seated against the back seating surfaces 208 with the tab 546 inserted into the retaining recess 228 of the spring seat 226, and the tongue 528 of the lower housing component 504 is correspondingly in contact with the arcuate front seating surface 210 of the neck 206. Additionally, the drive pin 232 of the handle 200 is operatively connected with (e.g., inserted into) the follower 522 of the cutting assembly 508. In this manner, the follower 522, and hence the movable blade 516, can be oscillated via operation of the motor.

FIGS. 16-20 illustrate another embodiment of a cutter head (indicated generally at 600). The cutter head 600 includes a housing 602 with a lower housing component 604 and an upper housing component 606. The components 604, 606 connect together to house a cutting assembly 608 in an interior compartment of the cutter head 600 and to define an elongate slot 610 from which the cutting assembly 608 extends for trimming hair. Alternatively, the housing 602 may have any suitable number of components arranged in any suitable manner (e.g., in another embodiment, the lower housing component 604 and the upper housing component 606 may be integrally formed together as a single housing component).

Figure 20:
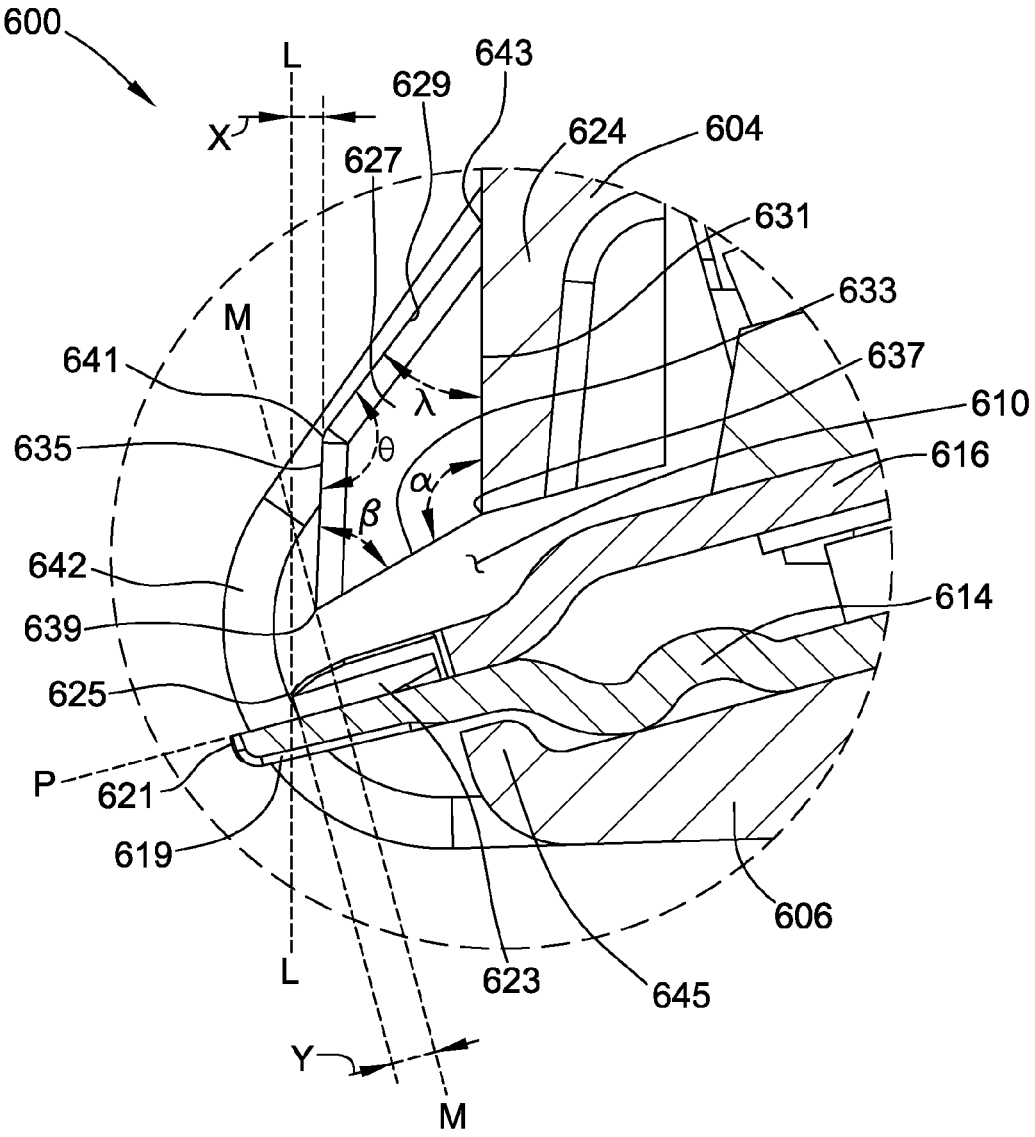
FIG. 20 is an enlarged view of the cross-section of FIG. 19 taken within portion 20.

The illustrated cutting assembly 608 includes a stationary blade 614 and a movable blade 616 that is biased against the stationary blade 614 via a biasing member such as, for example, a coil spring 618, thereby maintaining the movable blade 616 in sliding, face-to-face contact with the stationary blade 614 to define a shearing plane P (FIG. 20). The stationary blade 614 has a plurality of teeth 619 (FIG. 20) each having a tip 621 (FIG. 20), and the movable blade 616 has a plurality of teeth 623 (FIG. 20) each having a tip 625 (FIG. 20). Additionally, a base 620 is operatively connected to, and extends downward from, the movable blade 616 such that a follower 622 is accessible for oscillating the movable blade 616 during operation of the trimmer 100. In other embodiments, the cutting assembly 608 may be configured in any suitable manner (e.g., the biasing member may be a leaf spring, rather than coil spring 618).

In the illustrated embodiment, the lower housing component 604 of the housing 602 has a front wall 624, opposing side walls 626, and a plurality of guard teeth 627 that are integrally formed together. The guard teeth 627 are substantially equally spaced apart from one another along the front wall 624, and the front wall 624 has a tongue 628 sized to cover the aperture 214 in the neck 206 when the cutter head 600 is connected to the handle 200, as described in more detail below (e.g., the tongue 628 is substantially arcuately shaped in the illustrated embodiment). Suitably, the guard teeth 627 may have any spacing along the front wall 624, and the tongue 628 may have any shape that facilitates enabling the lower housing component 604 to function as described herein.

The lower housing component 604 also includes a pair of interior bosses (not shown), a pair of inwardly facing, resiliently flexible clips 632, an open bottom 634, and an open back 636. The open bottom 634 and back 636 together define an inlet 638 for insertion of the neck 206 of the handle 200 to facilitate releasable connection of the cutter head 600 to the handle 200 via the clips 632 and the slide 222. In other embodiments, the lower housing component 604 may be configured for any suitable connection of the housing 602 to the handle 200.

In the illustrated embodiment, the upper housing component 606 has a top wall 640, opposing side walls 642, and a back wall 644. The top wall 640 includes a front lip 645 oriented toward the blades 614, 616 (i.e., substantially perpendicular to the shearing plane P) in the assembled configuration of the cutter head 600 (FIG. 20), and the back wall 644 includes a rearwardly extending tab 646. Each of the side walls 642 extends forward of the front lip 645, and the back wall 644 is spaced apart from the side walls 642 to define openings 648. Support members 650 facilitate locating, orienting, and retaining the cutting assembly 608 within the interior compartment of the housing 602 upon assembly of the cutter head 600. At least a portion 652 of the front of the upper housing component 606 is open such that, when connected together with the front wall 624 of the lower housing component 604, the portion 652 and the front wall 624 define the elongate slot 610 of the housing 602 through which the cutting assembly 608 extends from the interior compartment of the housing 602.

With particular reference now to FIG. 20, each of the illustrated guard teeth 627 has a first side 631, a second side 633, a third side 635, and a fourth side 629. A first vertex region 637 connects the first side 631 to the second side 633, and a second vertex region 639 connects the second side 633 to the third side 635. Additionally, a third vertex region 641 connects the third side 635 to the fourth side 629, and a fourth vertex region 643 connects the fourth side 629 to the first side 631. As such, each illustrated guard tooth 627 extends from a proximal base, which is defined at least in part by the junction of the first side 631 and the front wall 624, to a distal tip, which is defined at least in part by the second vertex region 639. Suitably, each of the illustrated guard teeth 627 may have any number of sides connected together at any number of vertex regions that facilitates enabling the guard teeth 627 to function as described herein.

In the illustrated embodiment, the first side 631 and the second side 633 are oriented obliquely relative to one another to form an obtuse angle α at the first vertex region 637, and the second side 633 and the third side 635 are oriented obliquely relative to one another to form an acute angle β at the second vertex region 639. Similarly, the third side 635 and the fourth side 629 are oriented obliquely relative to one another to form an obtuse angle θ at the third vertex region 641, and the fourth side 629 and the first side 631 are oriented obliquely relative to one another to form an acute angle λ at the fourth vertex region 643. In this manner, the sides 631, 633, 635, 629 are arranged such that the guard tooth 627 has a generally diamond-shaped profile, with the third vertex region 641 being less pointed than the second vertex region 639 (i.e., the second vertex region 639 has a more narrowly rounded profile than the third vertex region 641 such that the third vertex region 641 is configured for sliding more smoothly along the skin, while the second vertex region 639 is configured for better inhibiting the ingress of skin into the cutting area of the cutting assembly 608, as set forth in more detail below). In other embodiments, each of the guard teeth 627 may have any suitable profile shape that facilitates enabling the guard teeth 627 to function as described herein.

To assemble the cutter head 600, the cutting assembly 608 is located in the upper housing component 606 via the support members 650, and the lower housing component 604 is connected to the upper housing component 606 via the interior bosses (not shown) and/or any other suitable connector (e.g., a snap-fit mechanism, an adhesive, thermal bonding and/or welded connection, and/or another suitable mechanical fastener). With the side walls 642 of the upper housing component 606 abutting the side walls 626 of the lower housing component 604, the cutting assembly 608 is thereby housed in the interior compartment of the housing 602 such that the cutting assembly 608 is substantially enclosed within the housing 602 except for the blades 614, 616 extending outward from the elongate slot 610 of the housing 602 such that the teeth 619, 623 of the blades 614, 616 are external of the housing 602 (FIG. 20).

In this manner, the support members 650 suitably locate (e.g., maintain the orientation and position of) the cutting assembly 608 within the housing 602 such that the guard teeth 627 at least partially shield the area in which the teeth 619, 623 of the blades 614, 616 are in shearing contact with one another along the shearing plane P. More specifically, the housing 602 is configured such that, when the blade assembly 608 is housed within the interior compartment of the housing 602, the optimized profile shape and disposition of the guard teeth 627 relative to the movable blade 616 facilitate trimming hair to a more even, and shorter, length along the entire width of the cutting path, while effectively inhibiting skin from being nicked by the blades 614, 616.

As set forth above, the sides 631, 633, 635, 629 are arranged such that the guard tooth 627 has a substantially diamond-shaped profile (i.e., each guard tooth 627 has opposing obtuse angles α, θ and opposing acute angles β, λ, with one acute angle λ being located at the proximal base and the other acute angle β being located at the distal tip). In this configuration, the acute angle β at the distal tip of the guard tooth 627 is pointed toward the tip 625 of the associated movable blade tooth 623, with the third side 635 of the guard tooth 627 being oriented obliquely relative to the shearing plane P to facilitate improved operation of the cutter head 600. More specifically, the third side 635 has a substantially planar profile (FIG. 20) oriented such that, during operation, skin contacting the third side 635 is supported in an orientation that is substantially tangent to the tip 625 of the associated movable blade tooth 623 and oblique to the shearing plane P, thereby enabling hair to be trimmed to a minimum length while inhibiting an ingress of skin between the teeth 623 of the movable blade 616. In one particular embodiment, the third side 635 is oriented such that the third side 635 is offset (i.e., recessed) by a distance X of about 0.2 millimeters (mm) from an imaginary line L that is oriented parallel to the third side 635 and tangent to the tip 625 of the associated movable blade tooth 623. In other embodiments, the third side 635 may have any suitable disposition relative to the tip 625 and the shearing plane P that enables the guard teeth 627 to function as described herein.

Furthermore, the illustrated second vertex region 639 is offset (i.e., recessed) from the tip 625 of the associated movable blade tooth 623 such that the guard tooth 627 does not extend beyond the tip 625 (FIG. 20). This offset relationship between the second vertex region 639 and the tip 625 of the associated movable blade tooth 623 enables the cutter head 600 to trim hair to a shorter, and more even, length along the entire width of the cutting path (e.g., facilitates preventing a striped pattern from resulting in the hair after a trimming operation). In one particular embodiment, the second vertex region 639 of the guard tooth 627 is offset from the tip 625 of the associated movable blade tooth 623 such that an imaginary line M that is tangent to the second vertex region 639 of the guard tooth 627 and perpendicular to the shearing plane P is recessed from the tip 625 of the associated movable blade tooth 623 by a distance Y of about 0.5 millimeters (mm) measured in the shearing plane P. Alternatively, each guard tooth 627 may have any suitable disposition relative to the tip 625 of the associated movable blade tooth 623 that facilitates enabling the guard tooth 627 to function as described herein.

Additionally, the orientation of the second side 633 of the illustrated guard tooth 627 has been optimized to facilitate more effective operation of the cutter head 600 and easier fabrication (e.g., molding) of the housing 602. For example, the second side 633 of the illustrated guard tooth 627 is substantially planar and is oriented obliquely relative to the shearing plane P (FIG. 20). In this manner, the second side 633 facilitates easier fabrication (e.g., molding) of the guard tooth 627 on the front wall 624 and better disposition of the guard tooth 627 relative to the associated movable blade tooth 623 when the cutting assembly 608 is disposed within, and extends from, the housing 602 (i.e., the orientation of the second side 633 enables the guard tooth 627 to be closer to the associated movable blade tooth 623 at the distal tip of the guard tooth 627 than at the proximal base of the guard tooth 627, thereby simultaneously providing better shielding of the movable blade teeth 623 from the skin near the tips 625 and greater clearance between the movable blade 616 and the guard teeth 627 near the proximal base of the guard teeth 627). In other embodiments, the second side 633 of the guard tooth 627 may have any suitable disposition relative to the shearing plane P and/or the movable blade 616 that facilitates enabling the guard tooth 627 to function as described herein.

Moreover, the illustrated cutter head 600 has each side wall 642 extending forward of the front lip 645, forward of the tips 625 of the movable blade teeth 623, and forward of the distal tips of the guard teeth 627 such that the entire profile of each guard tooth 627 is completely within the profile of the side walls 642 (FIG. 20). However, the stationary blade 614 extends beyond the side walls 642 such that the tips 621 of the stationary blade teeth 619 are forward of (i.e., are not within the profile of) the side walls 642, thereby enabling the stationary blade 614 to contact the skin forward of the side walls 642 for "combing" (or lifting) the hair during a trimming operation. Thus, because the side walls 642 extend beyond the movable blade 616 but not beyond the stationary blade 614, the side walls 642 are configured to support the skin during trimming (e.g., the side walls 642 are configured to facilitate absorbing a load when a user pushes the tips 621 of the stationary blade teeth 619 against the skin with excessive force). Notably, as the skin may also be contacting the third side 635 of the guard teeth 627 during some operations of the cutter head 600, the guard teeth 627 may perform a similar load absorbing function in the event of excessive force application, and this load absorbing function of the guard teeth 627 also facilitates inhibiting the blades 614, 616 from nicking the skin during a trimming operation. As an additional benefit, the front lip 645 provides a thickened region of the top wall 640 at the elongate slot 610 (FIG. 20) to facilitate minimizing deflection (e.g., bending or warping) of the top wall 640 and, therefore, deflection (e.g., bending or warping) of the stationary blade 614 during a trimming operation.

Like the cutter heads 300, 500 described above, the cutter head 600 is connected to the handle 200 by inserting the winged guide walls 216 of the neck 206 through the openings 648 of the upper housing component 606. As the cutter head 600 is moved down the decline of the side seating surfaces 212 and toward the back seating surfaces 208, the clips 632 of the cutter head 600 slide along the channels 218 until they engage (i.e., are inserted into) the retaining recesses 220 of the channels 218. When the clips 632 engage the retaining recesses 220, the cutter head 600 is seated against the back seating surfaces 208 with the tab 646 inserted into the retaining recess 228 of the spring seat 226, and the tongue 628 of the lower housing component 604 is correspondingly in contact with the arcuate front seating surface 210 of the neck 206. Additionally, because the base 620 of the cutting assembly 608 is accessible through the open bottom 634 of the lower housing component 604, the drive pin 232 of the handle 200 is operatively connected with (e.g., inserted into) the follower 622 of the cutting assembly 608. In this manner, the follower 622, and hence the movable blade 616, can be oscillated via operation of the motor. After a trimming operation has concluded, the cutter head 600 may be ejected from the handle 200 as described above.

Again, because the tongue 628 of the lower housing component 604 has a larger profile than that of the follower 622 of the cutting assembly 608 (FIG. 16), the follower 622 is provided with adequate clearance for ejection of the cutter head 600 from the handle 200 at an oblique angle relative to the longitudinal axis 202 of the handle 200 without interference from the neck 206. Suitably, other embodiments of the cutter head 600 and/or the handle 200 may provide for any attachment of the cutter head 600 to, or removal of the cutter head 600 from, the handle 200 (e.g., other embodiments of the cutter head 600 may provide for removal of the cutter head 600 from the handle 200 by grasping the cutter head 600 and pulling the cutter head 600 off of the handle 200, rather than ejecting the cutter head 600 from the handle 200 as described herein).

In the illustrated embodiment, the cutter head 600 is suitably fabricated from materials such that the entire cutter head 600 is disposable after use. Additionally, because the cutter head 600 is intended to be disposable in one embodiment, the amount of material used to make the cutter head 600 should be minimized such that the cutter head 600 can be manufactured in a less expensive manner. Hence, the arcuate shape of the tongue 628 permits the front wall 624 to be sized large enough to provide clearance for the follower 622 during ejection, while enabling the side walls 626 to be sized smaller than the front wall 624 in order to reduce the amount of material used to manufacture the cutter head 600. In other embodiments, the cutter head 600 may be fabricated from materials that are suitable for long-term, repeated use, such that the cutter head 600 is not intended to be disposable. The stationary and/or movable blades 614, 616 described herein may suitably be fabricated from a metallic material, a ceramic material, or a metallic material that is at least partially coated in a synthetic or semi-synthetic, organic-based polymer (e.g., polytetrafluoroethylene (PTFE)). Suitably, the cutter head 600 may be packaged and attached to the handle 200 in the manner described above for the cutter head 300.

When introducing elements of the present invention or the preferred embodiment(s) thereof, the articles "a", "an", "the", and "said" are intended to mean that there are one or more of the elements. The terms "comprising," "including", and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. An electric hair trimmer comprising:

a handle having a longitudinal axis;

a drive system;

a cutter head comprising a stationary blade and a movable blade, the cutter head being releasably connectable to the handle in operative connection with the drive system, said cutter head being slidable onto and off of the handle in a direction oblique to the longitudinal axis of the handle;

a slide that is displaceable relative to the handle to initiate ejection of the cutter head from the handle along said slidable direction of the cutter head; and a resilient member facilitating ejection of the cutter head from the handle in the slidable direction of the cutter head.

2. The electric hair trimmer set forth in claim 1 wherein the cutter head further comprises:

a follower connected to the movable blade, wherein said follower is configured to be operatively connected to the drive system for oscillating the movable blade via the drive system; and a tongue configured to provide clearance for the follower when the cutter head is ejected along said slidable direction obliquely relative to the longitudinal axis.

3. The electric hair trimmer set forth in claim 2 wherein the handle comprises a neck configured with an aperture that provides clearance for the follower when the cutter head is ejected obliquely relative to the longitudinal axis of the handle.

4. The electric hair trimmer set forth in claim 1 wherein the handle comprises said resilient member that is in the form of a spring, the slide being displaceable against the bias of the spring to initiate ejecting the cutter head.

5. The electric hair trimmer set forth in claim 1 wherein the handle further comprises a retaining recess, the cutter head further comprising a clip configured for insertion into the retaining recess upon sliding the cutter head onto the handle for releasable connection to the handle, and removal from the retaining recess when the cutter head is ejected from the handle.

6. The electric hair trimmer set forth in claim 5 wherein the clip is resiliently flexible to further facilitate ejecting the cutter head from the handle along the slidable direction of the cutter head.

7. The electric hair trimmer set forth in claim 6 wherein the handle comprises a channel having the retaining recess, the clip configured to slide along the channel for insertion into the retaining recess during connection of the cutter head to the handle.

8. The electric hair trimmer set forth in claim 1 wherein the cutter head extends forward from the handle for cutting hair.

* * * * *